US009239191B2

(12) United States Patent
Gibson

(10) Patent No.: US 9,239,191 B2
(45) Date of Patent: Jan. 19, 2016

(54) MOBILE FURNACE SYSTEM

(71) Applicant: Donald B. Gibson, Spokane, WA (US)

(72) Inventor: Donald B. Gibson, Spokane, WA (US)

( * ) Notice: Subject to any disclaimer, the term of this patent is extended or adjusted under 35 U.S.C. 154(b) by 301 days.

(21) Appl. No.: 13/935,856

(22) Filed: Jul. 5, 2013

(65) Prior Publication Data

US 2013/0295511 A1 Nov. 7, 2013

Related U.S. Application Data

(63) Continuation of application No. 12/751,277, filed on Mar. 31, 2010, now Pat. No. 8,506,291.

(60) Provisional application No. 61/167,039, filed on Apr. 6, 2009.

(51) Int. Cl.
*F27B 19/00* (2006.01)
*F27B 13/02* (2006.01)

(52) U.S. Cl.
CPC *F27B 19/00* (2013.01); *F27B 13/02* (2013.01)

(58) Field of Classification Search
CPC ..... F27B 9/00; F27B 9/02; F27B 9/029; F27B 9/14; F27B 9/20; F27B 9/26; F27B 2009/264; F27B 2009/266; F27B 2009/268
USPC ..... 432/11, 27, 62, 92, 121, 128, 133
See application file for complete search history.

(56) References Cited

U.S. PATENT DOCUMENTS 3,071,356 A 1/1963 Duffy
3,331,681 A 7/1967 Mobley
3,477,705 A 11/1969 Mobley
3,736,615 A 6/1973 Kumaki
3,950,602 A 4/1976 Korsten et al.
4,017,673 A 4/1977 Michels et al.
4,253,823 A * 3/1981 Holdner ..... F27B 13/00 34/429
4,394,766 A 7/1983 Karagoz
4,552,530 A * 11/1985 Gunnes ..... F27B 13/12 432/18
4,730,339 A 3/1988 Corato et al.
4,739,974 A 4/1988 Mordue (Continued)

FOREIGN PATENT DOCUMENTS

EP 1494390 1/2005
WO WO03076216 9/2003

OTHER PUBLICATIONS

"Industrial Furnaces for Carbon Products", Open Top Ring Pit Furnace, Reidhammer Website,Carbon, "Industrial Furnaces for Carbon Products", retrieved on Apr. 9, 2009 at <<http://www7.sacmi.com/FilePdf/82/17/0.633033350492031250.pdf>>, 2 pgs., Apr. 9, 2009.

(Continued)

*Primary Examiner* — Alissa Tompkins
*Assistant Examiner* — Nathaniel Herzfeld
(74) *Attorney, Agent, or Firm* — Lindauer Law, PLLC

(57) ABSTRACT

A mobile furnace apparatus and system configured to process payload is disclosed. A plurality of mobile furnaces may be interconnected to form a modular mobile furnace train. A fire line is an area where heat is applied to the payload, while a service line is an area where loading of payload, unloading of payload, inspection, and ongoing maintenance may take place. The modular mobile furnace train allows separation of the fire line and service line, which may improve worker safety and decrease overall costs.

20 Claims, 14 Drawing Sheets

(56) References Cited

U.S. PATENT DOCUMENTS

| | | | | |
|---|---|---|---|---|
| 4,916,714 | A | 4/1990 | Antoni et al. | |
| 5,299,225 | A | 3/1994 | Karagoz et al. | |
| 6,004,130 | A | 12/1999 | Gibson | |
| 6,339,729 | B1 * | 1/2002 | Dreyer | F27B 13/02 432/47 |
| 6,719,944 | B2 | 4/2004 | Stercho | |
| 6,801,563 | B2 | 10/2004 | Stercho et al. | |
| 7,413,592 | B2 | 8/2008 | Bleifuss | |
| 7,950,921 | B1 * | 5/2011 | Woolsey | F27B 9/20 432/128 |
| 2006/0246391 | A1 * | 11/2006 | Gaur | F27B 9/047 432/121 |
| 2007/0128569 | A1 * | 6/2007 | Tenzek | F27B 9/029 432/121 |

OTHER PUBLICATIONS

"Industrial Furnaces for Carbon Products", Closed Type Ring Pit Furnace, Reidhammer Website, Cardon, "Industrial Furnaces for Carbon Products", retrieved on Apr. 9, 2009 at <<http:www7.sacmi.com/FilePdf/82/17/0.632799424604843750.pdf>>, 2 pgs., Sep. 9, 2009.

"Sanitaryware Excellent Tunnel Kiln", XLNt-Tunnel Kiln, Reidhammer Website, Sanitaryware, "Sanitaryware Excellent Tunnel Kiln", retrieved on Apr. 9, 2009 at <<http://www7.sacmi.com/FilePdf/82/17/063303334559015625 0.pdf>>, 2 pgs., Apr. 9, 2009.

"Sanitaryware Shuttle Kiln", SSK-Shuttle Kiln, Reidhammer Website, Sanitaryware, "Sanitaryware Shuttle Kiln", retrieved on Apr. 9, 2009 at <<http://www7.sacmi.com/FilePdf/82/17/0.632787133797031250.pdf>>, 2 pgs., Apr. 9, 2009.

"Sanitaryware Shuttle Kiln", HWS-Shuttle Kiln, Reidhammer Website, Sanitaryware, "Sanitaryware Shuttle Kiln", retrieved on Apr. 9, 2009 at <<http://www7.sacmi.com/FilePdf/82/17/0.633033348446406250.pdf>>, 2 pgs., Apr. 9, 2009.

"Santitaryware Tunnel Kiln", TWS-Tunnel Kiln with Car Conveyance, Reidhammer Website, Sanitaryware, "Sanitaryware Shuttle Kiln", retrieved on Apr. 9, 2009 at <<http://www7.sacmi.com/FilePdf/82/17/0.633033350492031250.pdf>>, 2 pgs., Apr. 9, 2009.

"Tableware Tunnel Kiln", TWT-Tunnel Kiln with Car Conveyance, Reidhammer Website, Tableware, "Tableware Tunnel Kiln", retrieved on Apr. 9, 2009 at <<http://www7.sacmi.com/FilePdf/82/17/0.632800911246093750.pdf>>, 2 pgs., Apr. 9, 2009.

"Technical Ceramics Shuttle Kiln", WFG-Shuttle Kiln, Reidhammer Website, Technical Ceramic, "Technical Ceramics Shuttle Kiln", retrieved on Apr. 9, 2009 at <<http://www7.sacmi.com/FilePdf/82/17/0632800911246093750.pdf>>, 2 pgs., Apr. 9, 2009.

Fischer, et al., "Anode Plants for Tomorrow's Smelters: Key Elements for the Production of High Quality Anodes", Fischer, et al. "Anode Plants for Tomorrow's Smelters: Key Elements for the Production of High Quality Anodes", DMG World Media, The Journal of Aluminium Production and Processing Aluminium International Today, vol. 21, No. 1, Jan./Feb. 2009, 4 pgs., Jan. 1, 2009.

* cited by examiner

MOBILE FURNACE SYSTEM

CROSS-REFERENCE TO RELATED APPLICATIONS

The present application is a continuation of U.S. Non-Provisional application Ser. No. 12/751,277 filed on Mar. 31, 2010 and entitled "Modular Mobile Furnace Train." Pending U.S. Non-Provisional application Ser. No. 12/751,277 is herein incorporated by reference in its entirety, and the benefit of the filing date of this pending application is claimed to the fullest extent permitted. U.S. Non-Provisional application Ser. No. 12/751,277 further claims priority to, and incorporates by reference, U.S. Provisional Application Ser. No. 61/167,039, filed on Apr. 6, 2009, entitled "Modular Mobile Furnace Train."

BACKGROUND

Metal production has evolved over time from the simple heating of ores to electrolytic processes such as those used in aluminum smelting. In the electrolytic aluminum smelting process, electrical current is applied to aluminum oxide through carbon anodes and cathodes. During the smelting process the carbon anodes, and to a lesser extent the cathodes, are consumed. In this application the term "anode" is used for simplicity, and not as a limitation.

Because electrolytic smelting relies upon the passage of an electric current through the anodes, impurities or defects which increase electrical resistance result in an undesirable increase in electricity consumption. Furthermore, impurities in the anodes can contaminate the melt, resulting in poor quality metals. A high-quality carbon anode typically contains less than 8% of volatiles and is properly baked by uniform heating to a specified temperature range. Improperly baked anodes may have higher than desired electrical resistance as well as physical characteristics such as hardness which are substandard.

In typical aluminum smelting, every two kilograms (kgs) of smelted aluminum consumes approximately one kg of carbon from a carbon anode. Given that worldwide smelting capacity of aluminum exceeds 42 million metric tons, there is a significant and ongoing demand for high-quality carbon products.

Currently, this demand is satisfied using several furnace technologies such as closed top furnaces ("CTF") and more commonly open top furnaces ("OTF"), which are also known as "ring furnaces." Due to operational difficulties including a risk of explosion, CTF's have met with disfavor in the industry and are no longer considered viable. Thus, the majority of current carbon anode production takes place in OTFs.

An OTF is constructed by building fixed pits which are surrounded by flues and headwalls. Refractory ducts at each end of the furnace known as "crossovers" provide a means of reversing gas flow to help create a continuous ring. Unbaked (or "green") carbon anodes are placed into these pits. To prevent slumping and air burning of the anodes, petroleum coke is packed around and on top of the anodes. A flammable material is fed into the flues and combusted, with the exhaust gas drawn off. The pit walls are permeable, and a slight negative pressure in the flues draws the volatile gasses from the carbon anodes into the flues where they may be combusted. Failure to combust these gasses may result in an explosion hazard.

In the conventional OTF, there may be dozens or hundreds of pits arranged in a grid. These pits and the surrounding flues, headwalls, and crossovers are built from thousands of tons of masonry which require large amounts of time and expensive skilled labor. Further complicating design and construction of an OTF facility is the need to accommodate moving large masses such as anodes, coke, and equipment with large, heavy, multi-purpose overhead cranes during production, resulting in expensive buildings with high ceilings and clear building spans.

In operation, each group of pits and flues between a pair of headwalls (a section) may be undergoing a different step in the production process. For example, one section may be heating up, while an adjacent section is performing a fired soak. An adjacent section may be cooling, while the next section is being unloaded. Meanwhile an empty section may be undergoing cleaning and maintenance for the next round of firing.

During carbon anode production in an OTF large "frames" are moved between the sections. Because the sections are fixed and may be at different phases of the production process as described above, a frame is lifted over other frames and placed in the appropriate section. This is one of the reasons why an OTF facility must have a high ceiling with clear spans. There are several different kinds of frames which must be moved, including fire frames, cooling frames, exhaust gas frames, instrument bridges, etc.

Movement of a fire frame is referred to as a "fire move." Because of the noxious fume and dust hazards involved in this highly dangerous environment, non-essential plant personnel are often evacuated during a fire move. Further complicating the production process in an OTF is the requirement to perform a fire reversal. Under the high temperatures experienced during operation, over time the headwalls may begin to lean or shift as the flues move in the direction of the fire. To even out this leaning, the direction of combustion gasses in flues may be changed. This change is known as a "fire reversal." However, given the complicated interconnection of headwalls and flues found in the OTF, performing a fire reversal is difficult. A fire reversal affects every section in an OTF, even though some sections may not require this adjustment. Because each flue reacts differently in operation, this may result in a fire reversal being made in sections where it is not required. In other words, the control over fire reversal in an OTF is too coarse.

The fixed arrangement of the OTF facility makes maintenance to the pits, flues, headwalls, and other equipment difficult. A pit, flue, or headwall in a section in need of repair may be immediately adjacent to a hot section, thus it cannot be repaired until the firing equipment has moved past and this area has been allowed to cool. Because of the operational shortcomings of the OTF, these sections often do not cool adequately. Quite simply, it is difficult and dangerous to make extensive repairs when the section being repaired is hot enough to broil a worker. As a result necessary repairs may be done without due care, or not done at all.

Additionally, the OTF design wastes a tremendous amount of energy. The complicated system of pits, flues, headwalls, crossovers, etc., results in many avenues for heat to escape, cold air to enter, excess heavy refractory that absorb heat, etc. Although energy can be recovered during the OTF process and used downstream, such recovery is severely compromised by these losses. As a result, large quantities of energy, typically delivered by the combustion of fossil fuels, are used. This results in significant outputs of carbon dioxide, as well as volatiles which emanate from the anodes during baking.

The OTF design also results in significant quantities of coke dust and exhaust gas. Loading and unloading of the carbon anodes generates coke dust. For example, loading a pit involves dumping coke into a pit, releasing clouds of coke dust. Unloading similarly stirs up coke dust. Movement of the carbon anodes covered with coke dust through the facility spreads coke dust even farther.

Exhaust gas results from the combustion of volatiles outgassed by the carbon anodes and supplemental fuel. To comply with environmental regulations, in many countries this exhaust gas must be scrubbed, or chemically processed, to remove pollutants. The larger the volume of exhaust air to be treated, the more extensive and expensive the scrubbers must be. The arrangement of pits, flues, and headwalls in an OTF results in a significant amount of air being drawn into the system, resulting in larger volumes of exhaust gas than necessary being produced. Furthermore, failure to combust outgassed volatiles may result in a further explosion hazard, such as occurs in CTFs.

Finally, the refractory and other equipment in an OTF is under constant attack. Constant thermal cycling expands and contracts materials, resulting in cracking. Volatiles outgassed from the carbon chemically attack refractory and other equipment. Movement of frames and the process of loading and unloading anodes results in mechanical damage when equipment hits pit walls, flues, and so forth. Given the combination of harsh environment and difficulty in performing ongoing maintenance, the OTF facility quickly falls into a poor operational state. Productivity drops, as does the quality of the anodes produced. To remedy the problem, the entire facility, or at least a major portion, must be shutdown, cooled, demolished, the rubble removed, and rebuilt. This is dangerous, inconvenient, time consuming, wasteful, and expensive work. This work incurs loss of production, and often includes the need for major repair to support equipment such as conveyors and cranes.

Thus, there is a significant need for a process and apparatus to produce high-quality carbon products without the significant drawbacks currently found in OTFs.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

As discussed above, current OTFs suffer from many severe drawbacks. These include a dangerous and expensive facility that quickly degenerates due to an inability to adequately and efficiently operate and provide effective ongoing maintenance to the operational components.

Disclosed in this application are modular mobile furnace trains which may be used for thermal processing of materials. Modular furnace trains require less energy, emit less carbon dioxide, emit fewer pollutants, and are safer to operate and maintain than currently existing furnace technologies. By way of illustration, and not as a limitation, this application refers to the process of producing carbon anodes, carbon cathodes, or both, suitable for electrolytic aluminum smelting in a baking process. However, other products may be produced using the mobile furnaces and processes described herein. For example a modular mobile furnace train may sinter, anneal, calcine, roast, or otherwise thermally process materials.

A mobile furnace includes one or more pits and flues. The mobile furnace may be mounted on a deck which may be relocated at least within the facility. The mobile furnace provides for processing and transport of materials with the same apparatus. A mobile furnace may be configured to include connections which permit coupling the flues of one mobile furnace with flues of one or more other mobile furnaces, combustion/cooling air manifolds, exhaust gas manifolds, or combinations of these.

A furnace train comprises interconnected two or more modular elements such as a mobile furnaces, start-up plenum, etc. For example, a furnace train may include a mobile furnace and start-up plenum, a plurality of mobile furnaces, or a combination of start-up plenum and plurality of mobile furnaces. Once interconnected, gasses may travel between mobile furnaces. For example, combustion/cooling air may enter a mobile furnace at the front of the train, pass through the flues of connected mobile furnaces, and is ultimately exhausted at an exit flue of the mobile furnace at the end of the train. Thus, much of the thermal energy used during the process is recaptured. Additionally, volatiles and other compounds are presented with additional opportunities to be combusted. As a result, overall energy efficiency is improved and the resulting exhaust gasses may contain fewer or compounds having lower toxicity.

A fire line is the area where one or more furnace trains operate. Generally, the fire line may be considered the area of maximum hazard due to exposure to heat and/or exhaust gas. A facility may have multiple fire lines.

The use of mobile furnaces in a furnace train conveys several benefits in the areas of construction, operation, and product quality.

Construction of a modular furnace train facility is significantly simpler than other technologies such as OTF. For example, a simple end wall made of an insulating material replaces the heavy firebrick headwalls of an OTF, significantly reducing the amount of material required to build the facility as well as the energy required to heat this refractory. The absence of crossovers further reduces the amount of material required compared to an OTF. Furthermore, the arrangement of service line operations such as loading, unloading, inspection, repair, etc., away from the fire line further minimizes the quantity of refractory material used in the facility by reducing the number of areas which are exposed to high temperatures.

A furnace train facility also uses smaller and simpler air handling equipment because of simpler air paths and reduced outside air infiltration. Material handling is also simplified and may use less expensive equipment for handling payload. For example, ground level equipment may be used for loading and unloading instead of expensive multipurpose cranes which require expensive support structures. Where mobile furnaces are configured with wheels, rollers, and so forth, cranes may be replaced with simpler and less expensive tractors, winches, and so forth to move the mobile furnaces from one area to another. Furthermore, the mobile furnaces not only act as furnaces, but convey the payload through the facility, eliminating the need for conveyors, cranes, etc. Finally, in many implementations, a furnace train facility may be built above-grade, thus eliminating the need for extensive excavation and backfill.

Operation of a furnace train facility is relatively simple, safe, and less expensive compared to other technologies. For example, loading and unloading of a mobile furnace is significantly safer than the traditional OTF. Loading and unloading takes place at a location other than the fire line. This significantly reduces costs and hazards by eliminating worker exposure to the more hazardous areas where high temperature, dust, and exhaust gas are present. Furthermore, less expensive loading/unloading equipment may be used since the pit end walls are removed. This reduces equipment elevation and greatly improves access. Less refractory and potentially more end product per pit are attainable as it is no longer necessary to lengthen the pits in order to retrieve coke and end product from these fixed pits. Also, instead of heavy castables and firebrick, lighter weight materials may also be used for the bulk of the mobile furnace and associated facility.

Ongoing inspection and repair also improves safety and efficiency. Each mobile furnace may be inspected during operation in the fire line and following decoupling from the furnace train. Inspection may include analysis of burn parameters such as temperatures and exhaust gas composition, imaging in various spectral bands such as visible and infrared, visual inspection, and so forth. Thus, damage may be quickly recognized and corrected. Minor damage may be corrected after exit from the fire line. Where damage is more extensive, the mobile furnace may be moved to a separate maintenance area. In either event, maintenance work on the pits and flues is completed in an environment which is significantly safer and cleaner than the traditional OTF pit floor.

The mobile furnace design also allows fire reversal at a very fine level of control. When a fire reversal is warranted, the mobile furnace is simply rotated end-for-end during the next trip through the fire line. Given the extreme simplicity and negligible cost of this operation, fire reversal may now take place as a preventative measure rather than a reactive response. This further increases the life of the equipment.

Furthermore, mobile furnaces are easily adapted to produce end products of different sizes, thus providing significantly greater production flexibility. For example, a furnace train may contain mobile furnaces with various sizes of product. Also, additional production capacity is quickly increased by simply increasing the number of cars in a furnace train, increasing the number of pits in a car, or adding additional furnace trains.

In one implementation, the modular furnace in a furnace train moves through one or more zones. A zone accommodates a particular step of a production profile. For example, the typical carbon anode production profile includes the steps of unfired heat-up, volatile fired heat-up, supplemental fuel fired heat-up, supplemental fuel fired soak, and cooling. Thus, in one implementation there are five separate zones to accommodate each of the steps in the carbon anode production profile.

Finally, the use of mobile furnaces results in improved product quality. A furnace train facility with decreased usage of heavy firebrick type refractory and increased usage of lightweight refractory and insulation results in more consistent and efficient heating of materials in production. In the case of carbon anodes, this improves volatile combustion, decreases the amount of supplemental fuel input required, and results in a higher quality anode and lower fuel usage. The continuing inspection and monitoring of the mobile furnaces further maintains consistency and efficiency of production at optimum levels.

The modular mobile furnace train thus provides increased overall efficiency and quality of end product with a simpler, cheaper, safer, cleaner, and more sustainable alternative to existing furnace designs.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Mobile Furnace Environment

Figure 1:
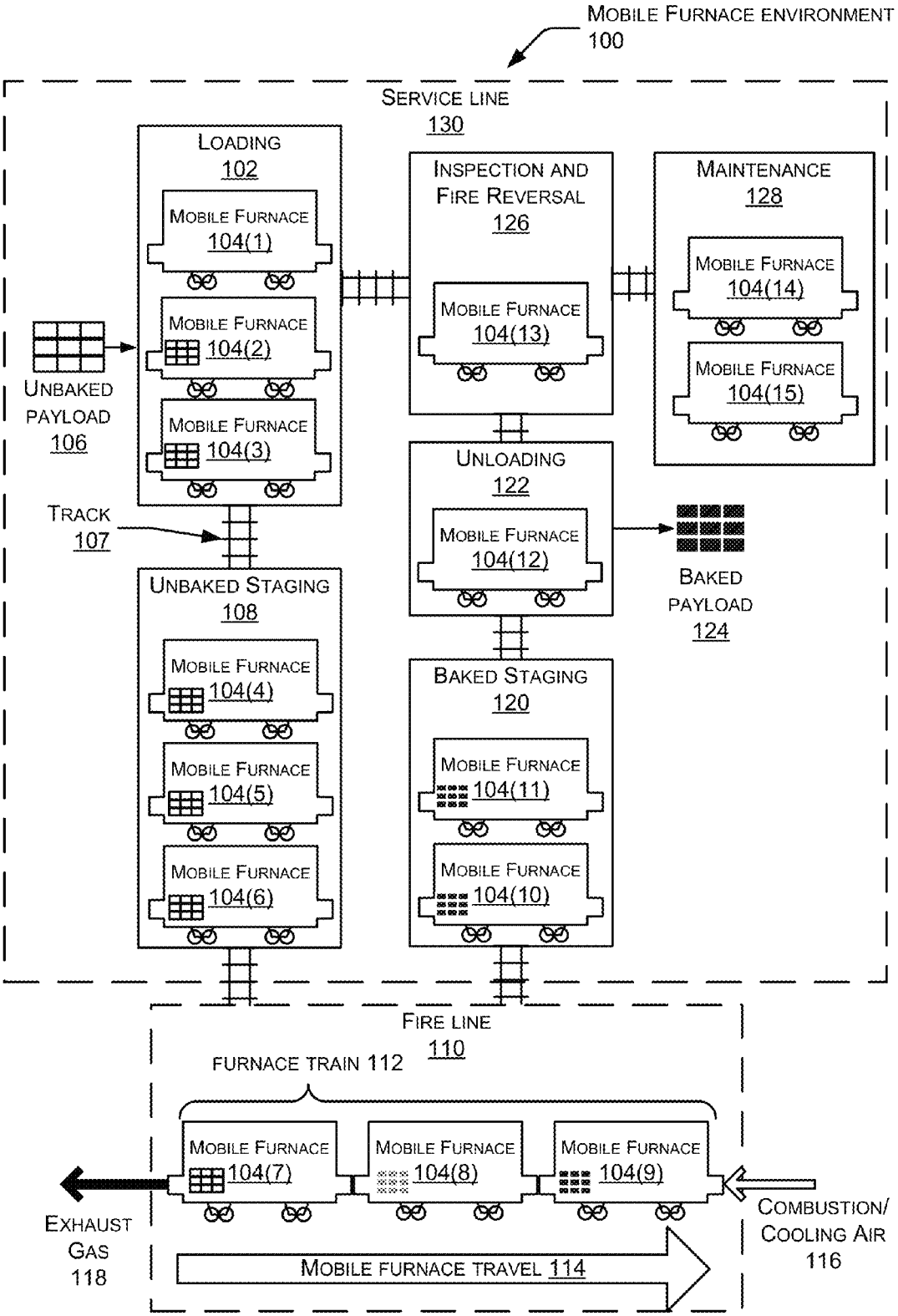
FIG. 1 is a schematic of an illustrative mobile furnace environment.

FIG. 1 is a schematic of an illustrative mobile furnace environment 100. In this application for purposes of illustration only, and not limitation, the payload and end product referred to are carbon anodes suitable for electrolytic aluminum smelting. Furthermore, the number of mobile furnaces shown in each area is for illustration, and not limitation. A loading area 102 is shown holding mobile furnaces 104(1), 104(2), and 104(3). A mobile furnace 104 comprises a pit for carrying payload, a heat source, a flue, and is described in more depth below in FIG. 4. At loading area 102, unbaked payload 106 is loaded into mobile furnaces 104. Payload is shown in this figure as a stack of blocks. However, payload may be a single piece, several irregularly shaped pieces, and so forth. A packing material such as coke may be placed around the payload during loading. In one implementation, this loading takes place at a point physically separate from where mobile furnace firing takes place, thus improving worker safety and comfort. Furthermore, payload loading and packing with coke may take place in a defined position instead of throughout the facility (as is the case with OTF). This allows dust and other environmental factors associated with loading and unloading to be more easily and less expensively controlled. For example, the loading area 102 may have additional air handling equipment to control coke dust. Once loading is complete, a mobile furnace 104 may be moved to another area. For illustration only and not as a limitation, tracks 107 are shown which permit wheeled mobile furnaces 104 to move from area to area.

An unbaked staging area 108 may be used to hold mobile furnaces until firing is desired. Shown in the unbaked staging area 108 are mobile furnaces 104(4), 104(5), and 104(6) with their load of unbaked payload 106. In one implementation, mobile furnaces carrying different payloads (such as different composition, different sizes, etc.) are staged, to be retrieved when needed. This allows greater flexibility and rapid change in production output. For example, mobile furnaces 104(4) and 104(5) may contain small carbon anodes, while 104(6) contains large carbon anodes.

A fire line area 110 is a designated location where a mobile furnace and its payload are heated. In this illustration, three mobile furnaces 104(7), 104(8) and 104(9), each at different zones in the process of firing the payload are interconnected to form a furnace train 112, which is discussed in more depth next in FIG. 2.

Combustion/cooling air 116, which may be used for combustion, cooling, or both in the mobile furnaces, enters the furnace train 112. Combustion/cooling air 116 may be delivered to the furnace train 112 via a duct, manifold, plenum, etc. In the implementation depicted, the overall direction of combustion/cooling air flow at 116 is counter to the motion 114 of mobile furnaces in the fire line 110. Exhaust gas 118 exits from the end of furnace train 112 and may be removed for treatment such as scrubbing, cooling, etc. Exhaust gas 118 may be removed from the furnace train 112 via a duct, manifold, plenum, etc.

A baked staging area 120 is shown, where mobile furnaces which have been decoupled from the furnace train 112 and exited the fire line 110 are staged. This staging permits additional time for cooling to increase safety and worker comfort during unloading, as well as allowing prioritization and changes in sequence of mobile furnace unloading. For example, mobile furnace 104(10) which followed mobile furnace 104(11) in the furnace train 112 may be given priority and unloaded first.

At unloading area 122, the mobile furnace may be opened and the baked payload 124 removed. The packing coke, if present, may also be removed. Similar to that described above, with respect to loading position 102, physical separation between the fire line 110 and unloading area 122 increases worker comfort and safety. For example, mobile furnace 104(12) in unloading area 122 has been unloaded. In one implementation, the loading, inspection, and unload functions may be combined into a common area.

Mobile furnaces 104 may then travel to inspection and fire reversal area 126. Here, the unloaded mobile furnace may be cleaned and inspected. For example, mobile furnace 104(13) is shown being inspected. Minor repairs to the mobile furnaces 104 may be made at this position. Furthermore, if a fire reversal is called for, the mobile furnace may be rotated to change its orientation 180 degrees in the fire line. Thus, a simple change of direction of a particular mobile furnace replaces a complicated change to firing equipment affecting an entire furnace. However, in other implementations the rotation may occur at other locations.

When major repairs are necessary, the mobile furnace is removed from service and repaired at a mobile furnace maintenance area 128. For example, mobile furnaces 104(14) and 104(15) are shown undergoing major repairs. In one implementation, the repair position may be located at another facility entirely. Additional mobile furnaces may also be stored in the maintenance area 128 and/or other areas to provide spares.

A service line 130 may comprise the loading 102, unbaked staging 106, baked staging 120, unloading 122, inspection and fire reversal 126, and maintenance 128 areas. Thus, firing operations where a furnace train is online may take place in a fire line 110, while non-firing offline operations may take place in a service line 130. A mobile furnace facility may comprise multiple fire lines 110, as well as multiple service lines.

This capability to constantly monitor, continually repair, and easily reverse the fire of the mobile furnaces produces several benefits. Well maintained furnaces produce better quality product and use less energy. Mobile furnaces allow quicker and safer access to the furnace for minor repairs. Prompt and rapid repair of minor damage results in lower overall repair costs, while minimizing impact on productivity and maximizing quality of the end product.

Furthermore, because of the modular nature of mobile furnaces, time sensitivity is decoupled from the production line. Stated another way, a damaged mobile furnace can be removed from service, repaired according to a regular schedule, while another replacement mobile furnace immediately takes its place. For example, the repair schedule may account for when specialized crafts, materials, or trades are available. This removes the time and financial pressure to make hasty repairs in dangerous conditions, while significantly minimizing operational impact. Continuing the example, production may continue through the night using other module furnaces while the damaged mobile furnace awaits a day shift mason to make repairs.

A fire line 110 may be configured to provide a variety of different production profiles. For example, a carbon anode production profile typically includes the steps of unfired heat-up, volatile fired heat-up, supplemental fuel fired heat-up, supplemental fuel fired soak, and cooling. An illustrative fire line is described next.

Figure 2:
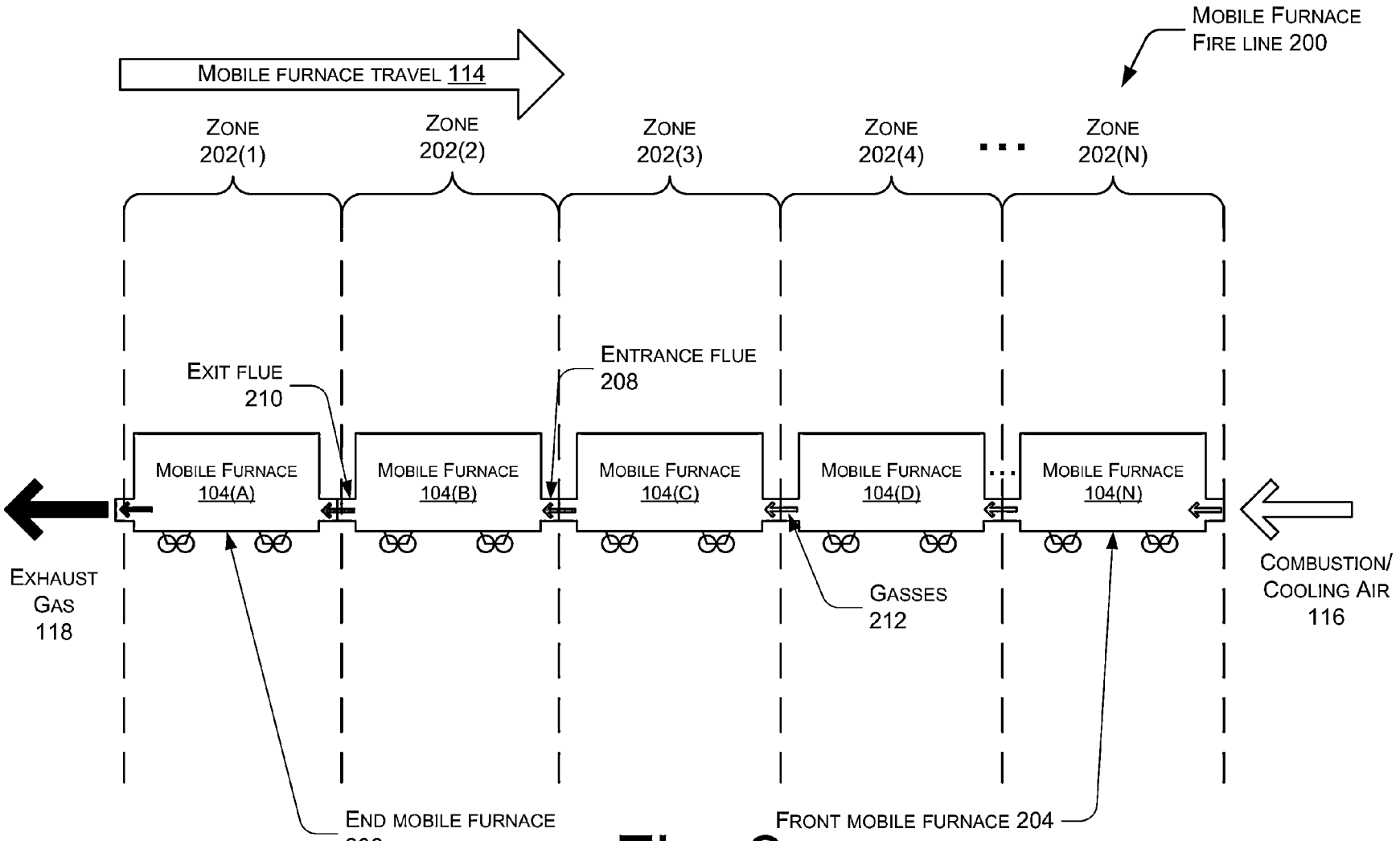
FIG. 2 is a schematic of an illustrative fire line with mobile furnaces baking carbon anodes.

FIG. 2 is schematic of an illustrative fire line with mobile furnaces baking carbon anodes that may, but need not, be implemented using the environment shown in FIG. 1. The schematic will be described in the context of the architecture of FIG. 1 for convenience and clarity.

Mobile furnaces 104(A)-104(N) are shown in fire line 200. Fire line 200 may comprise multiple zones, or process steps in a production profile to produce a desired end product. These zones are depicted as zone 202(1), zone 202(2), zone 202(3), zone 202(4), through zone 202(N), where N indicates a positive non-zero number. Thus number of zones may be increased or decreased to meet the requirements of a particular production profile. In this example, one mobile furnace is shown in each zone. Thus, mobile furnace 104(A) is in zone 202(1), mobile furnace 104(B) is in zone 202(2), mobile furnace 104(C) is in zone 202(3), mobile furnace 104(D) is in zone 202(4), and mobile furnace 104(N) is in zone 202(N). In other implementations multiple furnaces may be in the same zone.

Mobile furnaces 104(A)-104(N) are connected in series to form a furnace train. As described above, in one implementation the overall flow of gasses in the furnace train is counter to the direction of mobile furnace travel 114. As indicated by the arrows, combustion/cooling air 116 enters the front mobile furnace 204 and ultimately exits as exhaust gases 118 from the end mobile furnace 206. For descriptive purposes in this application the "front" and "end" of the furnace train is relative to the direction of travel 114 of mobile furnaces in the fire line. For example, a mobile furnace which has completed its firing is at the front of the furnace train, while a recently loaded and unfired mobile furnace is at the end.

In some implementations, a portion of the combustion/cooling air 116 which enters at the front of the furnace train exit prior to the end mobile furnace 206. For example, a portion of the combustion/cooling air 116 may be vented prior to entering supplemental fuel fired soak zone as described below with regards to FIG. 3. This may be done for several reasons including controlling combustion, controlling a zero point in the air flow, and so forth. The zero point refers to the point where the air pressure is zero as it transitions from pressurized at the entry end to a vacuum at the exit end. The positive air pressure is thus kept away from fired sections to avoid refractory damage from the heat of a bellows or forge effect.

As mentioned above, flues in each mobile furnace in the furnace train are connected to flues in adjacent mobile furnaces, or a start-up plenum as described later. This connection permits gasses to pass from one mobile furnace to the next. For reference in this application, an entrance flue 208 is positioned at a front of a mobile furnace and accepts gasses. An exit flue 210 is positioned at an end of the mobile furnace and emits exhaust gas. In this illustration, the gradual darkening of the gasses 212 indicated by arrows between mobile furnaces 104 indicates the transition from combustion/cooling air to exhaust gas.

This interconnection of flues provides several benefits. First, significant energy is recovered as gasses are pre-heated by the mobile furnace ahead. Second, due to the simpler path for gasses to travel, there is less surface area to provide heat loss and undesired air intrusion than in conventional systems. For example, the absence of headwalls and crossovers eliminates them as sources of heat loss and air intrusion. Third, the lower amount of air intrusion reduces the volume of exhaust gas produced, minimizing size and complexity of scrubbers.

Figure 3:
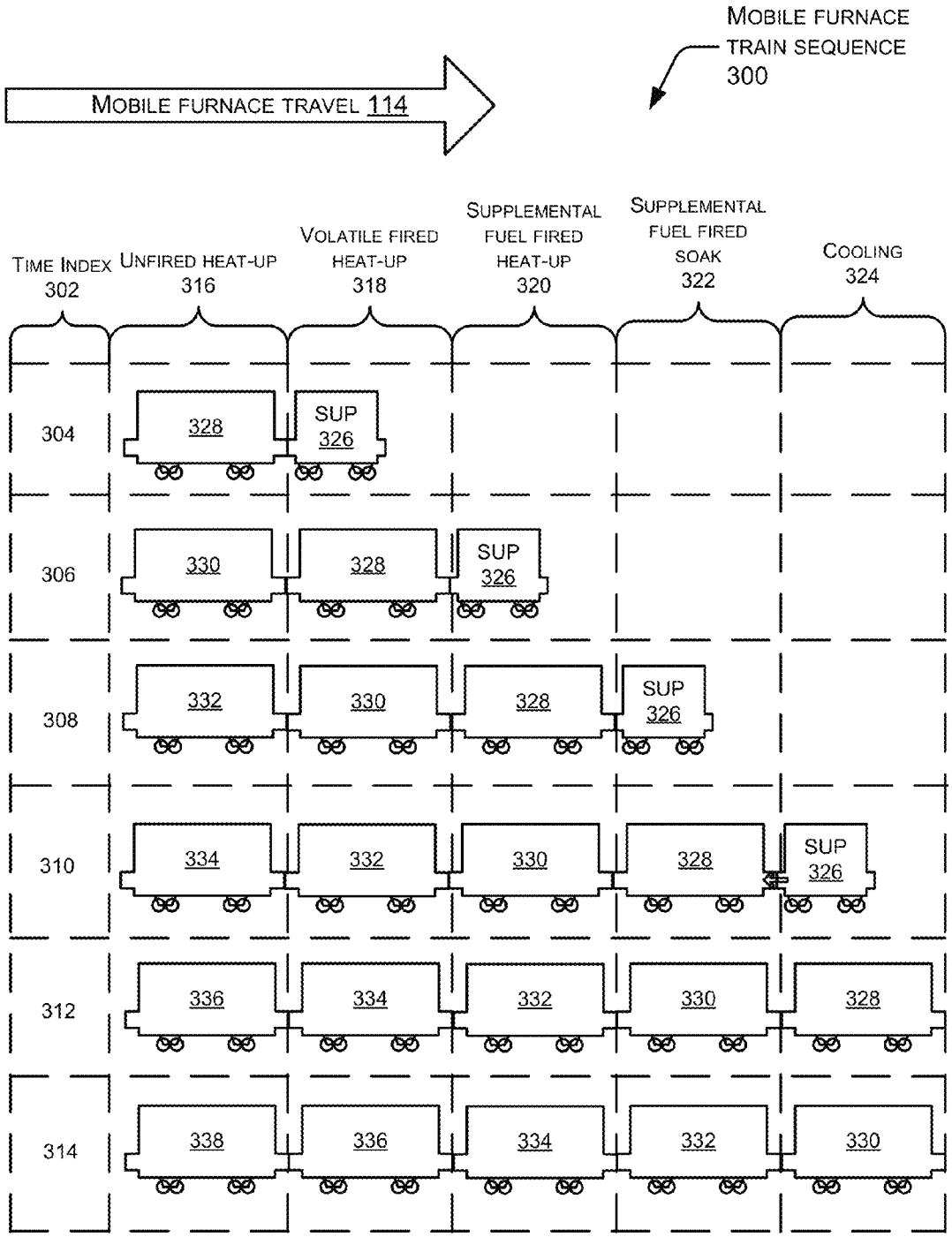
FIG. 3 is a schematic of an illustrative mobile furnace train sequence.

FIG. 3 is schematic of an illustrative mobile furnace train sequence that may, but need not, be implemented using the environment shown in FIG. 1. The schematic will be described in the context of the architecture of FIG. 1 for convenience and clarity.

This schematic is arranged in a grid having a vertical axis and a horizontal axis. The vertical axis shows a time index 302, with time increasing down the page. The time indices include 304, 306, 308, 310, 312, and 314. In one implementation, all time indices may be equal to the same interval. The horizontal axis shows zones in the production profile for carbon anode baking. From left to right, these zones are unfired heat-up 316, volatile fired heat-up 318, supplemental fuel fired heat-up 320, supplemental fuel fired soak zone 322, and cooling 324. Thus, each row as delineated by a time index depicts a furnace train at a given time, with the position of the mobile furnaces in the furnace train within zones of the production profile.

Fire line start-up involves the transition from a cold to operational condition. At time index 304, a start-up plenum ("SUP") 326 and a mobile furnace 328 comprise the initial furnace train. SUP 326 is in the volatile fired heat-up position 318, while mobile furnace 328 is at the unfired heat-up position 316. Because the furnace train lacks the full length of mobile furnaces which comprise an operational furnace train, the SUP emulates the behavior of other cars. This emulation includes providing exhaust gas of an appropriate volume, temperature, and in some implementations composition, to meet a desired production profile. The SUP may be a special apparatus, or a mobile furnace configured with supplemental equipment such as blowers, fuel input devices, etc. The SUP may be configured to draw air in with its own fans, or couple a combustion/cooling air 116 manifold, or a combination of these.

At time index 306, the furnace train of time index 304 advances one zone and a mobile furnace 330 is added to the end of the furnace train. The SUP 326 is now emulating a mobile furnace at the supplemental fuel fired heat-up position 320, while mobile furnace 328 is at the volatile fired heat-up 318 position and mobile furnace 330 is at the unfired heat-up 316 position.

At time index 308, the furnace train of time index 306 advances one zone and a mobile furnace 332 is added to the end of the furnace train. SUP 326 now emulates a mobile furnace at the supplemental fuel fired soak 322 position as well as emulating a supplemental fuel section upstream of the other supplemental positions.

At time index 310, the furnace train of time index 308 advances one zone and a mobile furnace 334 is added to the end of the furnace train. SUP 326 is now emulating a mobile furnace in the cooling 324 position. Throughout this illustration, it is understood that there may be multiple mobile furnaces at each zone. For example, if there are five cooling positions, SUP 326 would be moved through the five positions.

At time index 312, the furnace train of time index 310 advances one zone and a mobile furnace 336 is added to the end of the furnace train. Mobile furnace 328 is now at the cooling 324 position, and SUP 326 is removed. The fire line is now fully operational.

At time index 314, the furnace train of time index 312 advances one zone and a mobile furnace 338 is added to the end of the furnace train, while mobile furnace 328 is removed. This process may now continue, with mobile furnaces containing unbaked payload joining the end of the furnace train and mobile furnaces containing baked payload leaving the front of the furnace train. Movement of the furnace train along the fire line may be discrete or continuous. Thus, the furnace train may move at scheduled times for changes in zone, or be in continuous motion.

While a single mobile furnace is shown at each zone, other implementations may have multiple mobile furnaces at one or more of the zones. For example, there may be three mobile furnaces undergoing a supplemental fuel fired soak 322, two mobile furnaces undergoing volatile fired heat-up 318, etc. In another implementation, mobile furnaces may remain stationary during firing, with combustion/cooling air 116 and exhaust gas 118 being directed between the mobile furnaces to produce the desired flow of gasses through the production process. Mobile furnaces would then remain stationary during firing, while being moved into and out of the fire line for loading, unloading, inspection, maintenance, etc.

Configuration of an Illustrative Mobile Furnace

Figure 4:
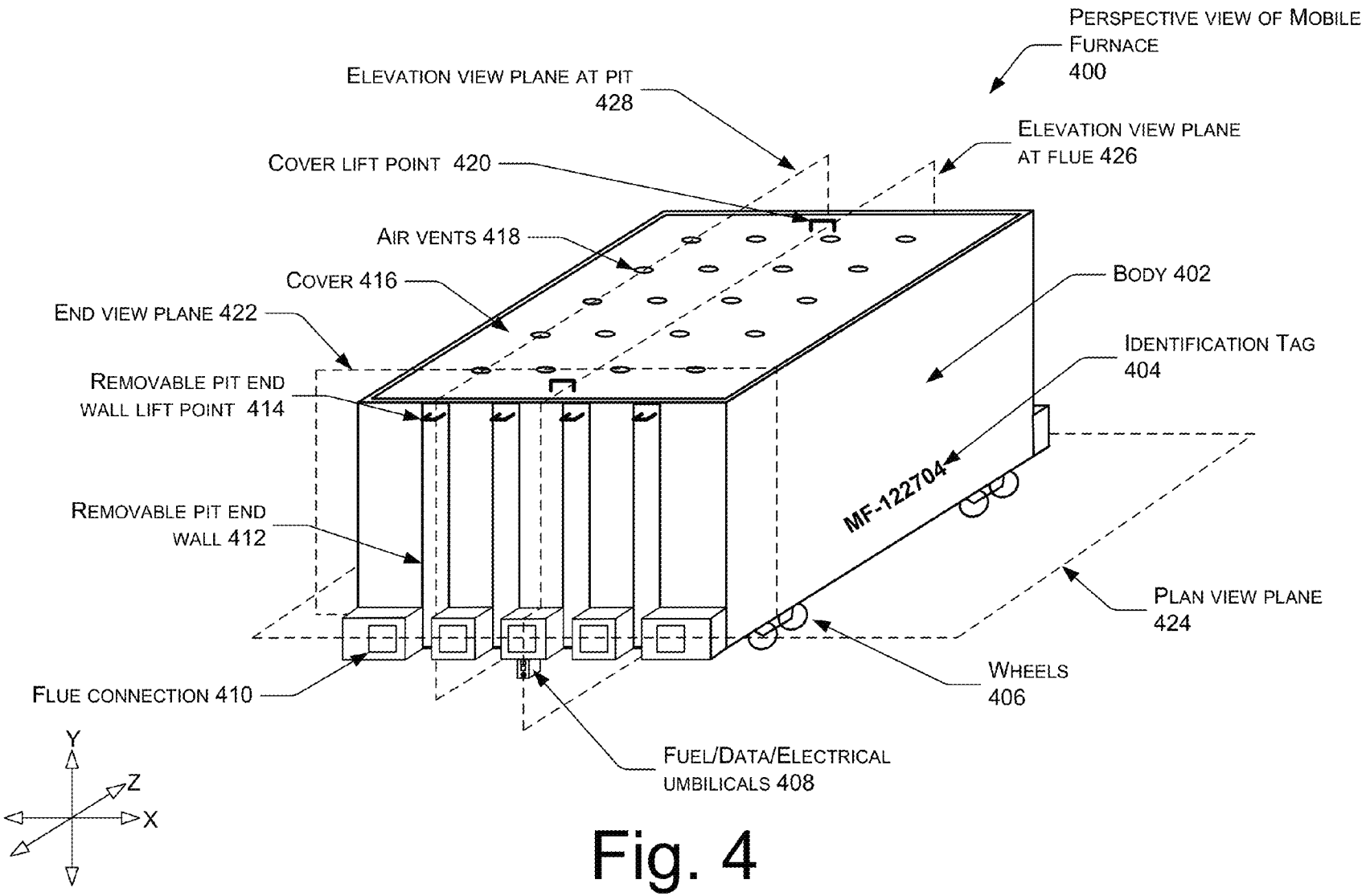
FIG. 4 is a schematic perspective view of an illustrative mobile furnace.

FIG. 4 is a schematic perspective view of an illustrative mobile furnace 400. A body 402 of a mobile furnace 104 is depicted. Within body 402 are pits to contain payload and flues for heating and gas removal. This internal arrangement is described in more depth in FIGS. 5-8. An identification tag 404 or other marking indicia used to distinguish mobile furnaces is shown on the side of body 402. This identification tag may include visual markings as depicted, or other markings such as optical or magnetic barcodes, radio frequency identification ("RFID") tags, mechanical flags, etc. These markings may be readable by a computing device to allow for automated tracking of mobile furnaces.

Wheels 406 are depicted on the underside of body 402. In other implementations castors, bearings, rollers, skids, or other suitable transportation mechanism may be used. Mobile furnaces may also be moved using an external trolley, truck, conveyor belt, crane, forklift, or other handling equipment.

Umbilical connections 408 are depicted at the centerline of the end of body 402. These connections may include fuel, data, electrical, or combinations thereof. The connections may be configured to allow two-way connections such that any connector can couple with other connectors without requiring an adapter. For example, during fire reversal when the orientation of direction of travel for the mobile furnace is changed in the fire line, the umbilicals would thus readily couple. In another implementation, fuel may be directly connected from a supply manifold adjacent to the fire line to each individual car. In one implementation, umbilical connections may be configured to couple and/or decouple without manual intervention.

At each end of the body 402 are one or more flue connections 410. These flue connections 410 may also be configured to allow two-way connections as described above. The flue connection 410 permits passage of gasses in and out of the flues within the mobile furnace. In one implementation, flue connections may be configured to couple and/or decouple without manual intervention.

Removable pit end wall 412 may be moved relative to body 402 to allow access to payload within a pit in body 402. A removable pit end wall lift point 414 may be provided to facilitate removal of the removable pit end wall 412. This lift point 414 may include hooks, loops, recesses, bars, rings, or other suitable attachment mechanism may be used. A plurality of lift points may also be used. In one implementation, removable pit end wall 412 may be hinged and remain attached to body 402 when open.

A cover 416 on the top of body 402 covers the pits and flues within. Depicted is a single piece cover. However, in other implementations, the cover 416 may comprise two or more separate pieces. Air vents 418 penetrate the cover 416 and provide airflow to pits below. Cover 416 may also incorporate lift cover lift point 420 which may include hooks, loops, recesses, bars, rings, or other suitable attachment mechanism may be used. A plurality of lift points may also be used. In one implementation, cover 416 may be hinged and remain attached to body 402 when open.

Figure 5:
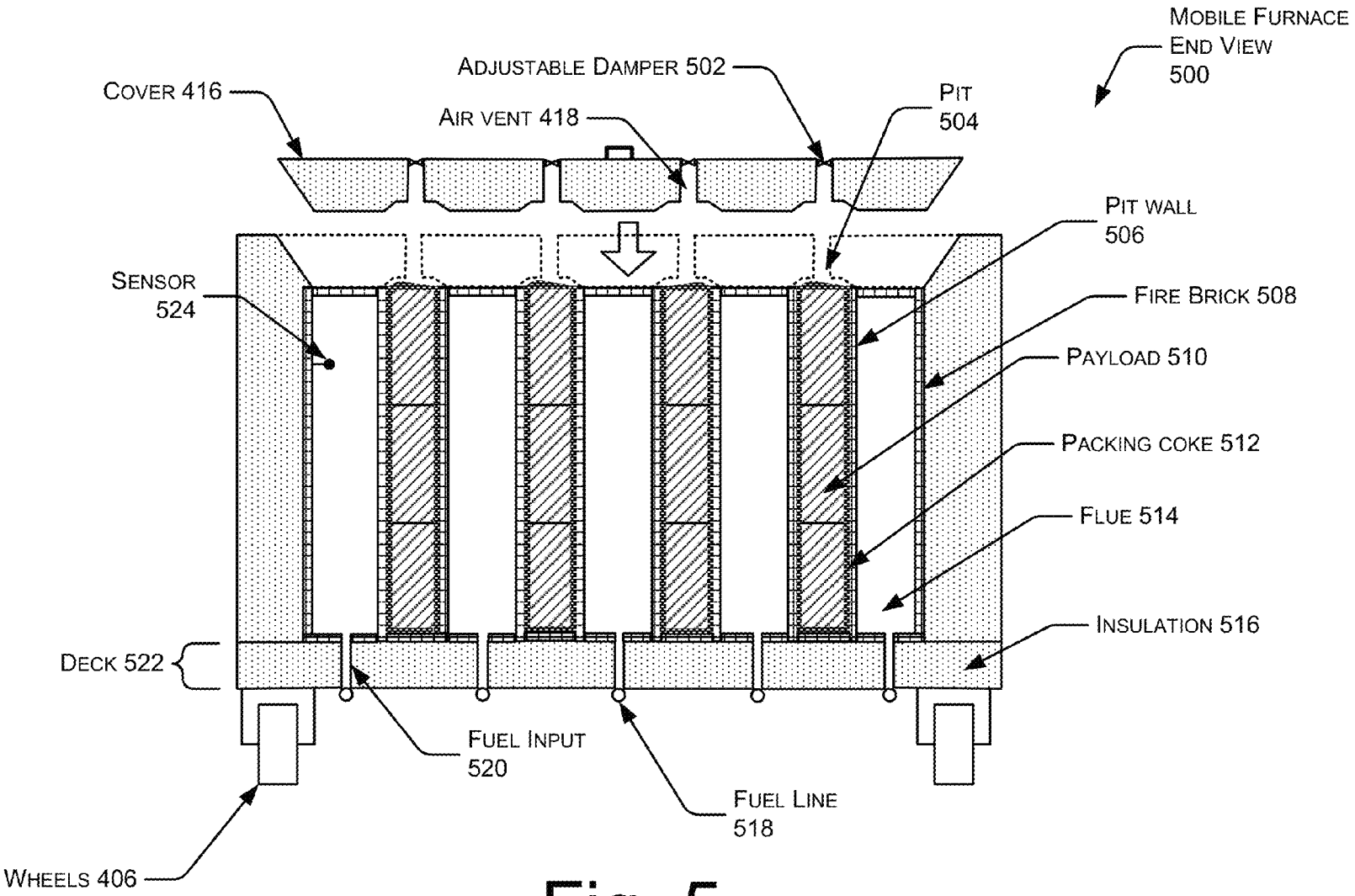
FIG. 5 is a schematic end view of the illustrative mobile furnace of FIG. 3.
Figure 6:
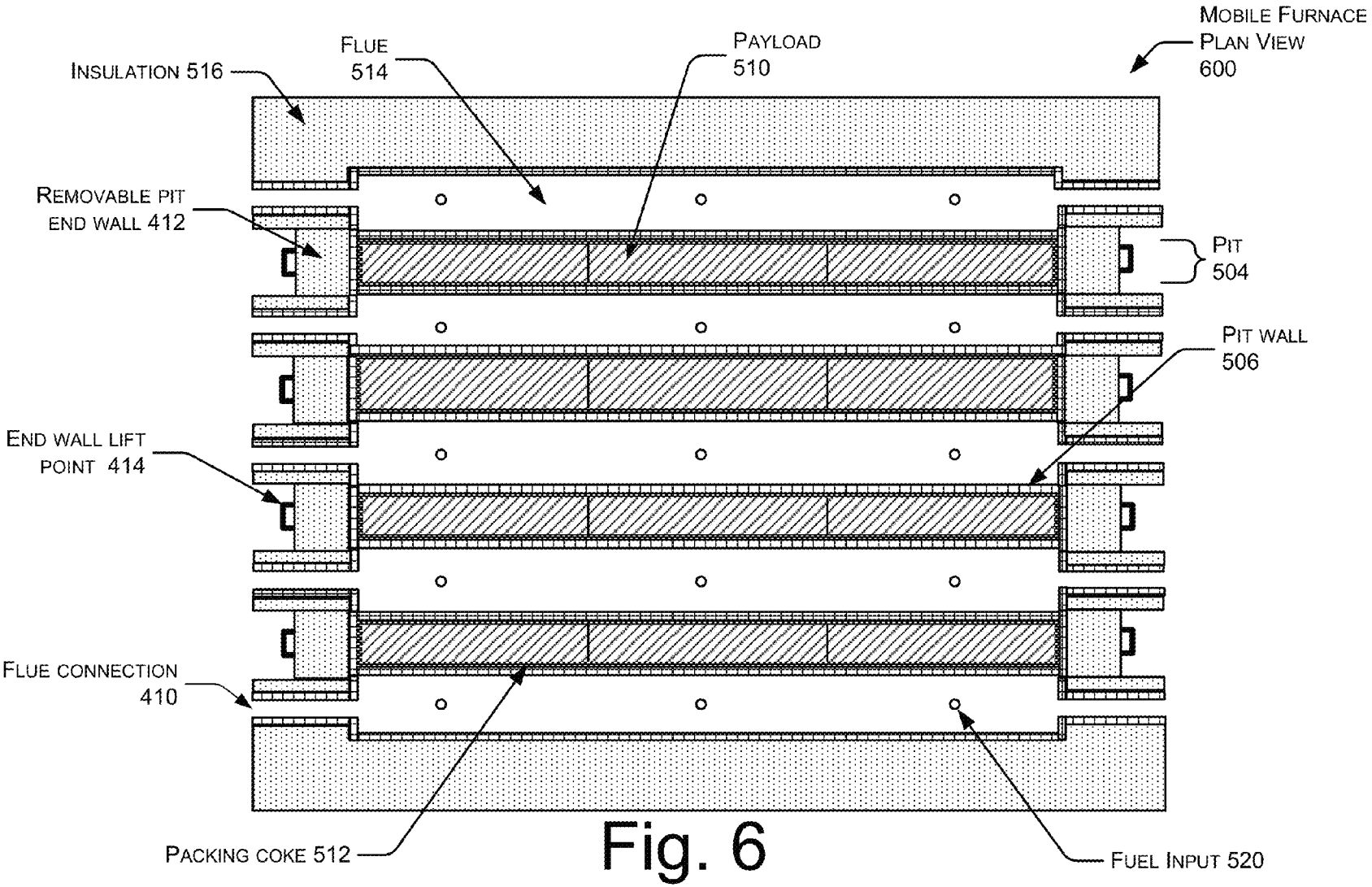
FIG. 6 is a schematic plan view of the illustrative mobile furnace of FIG. 3.
Figure 7:
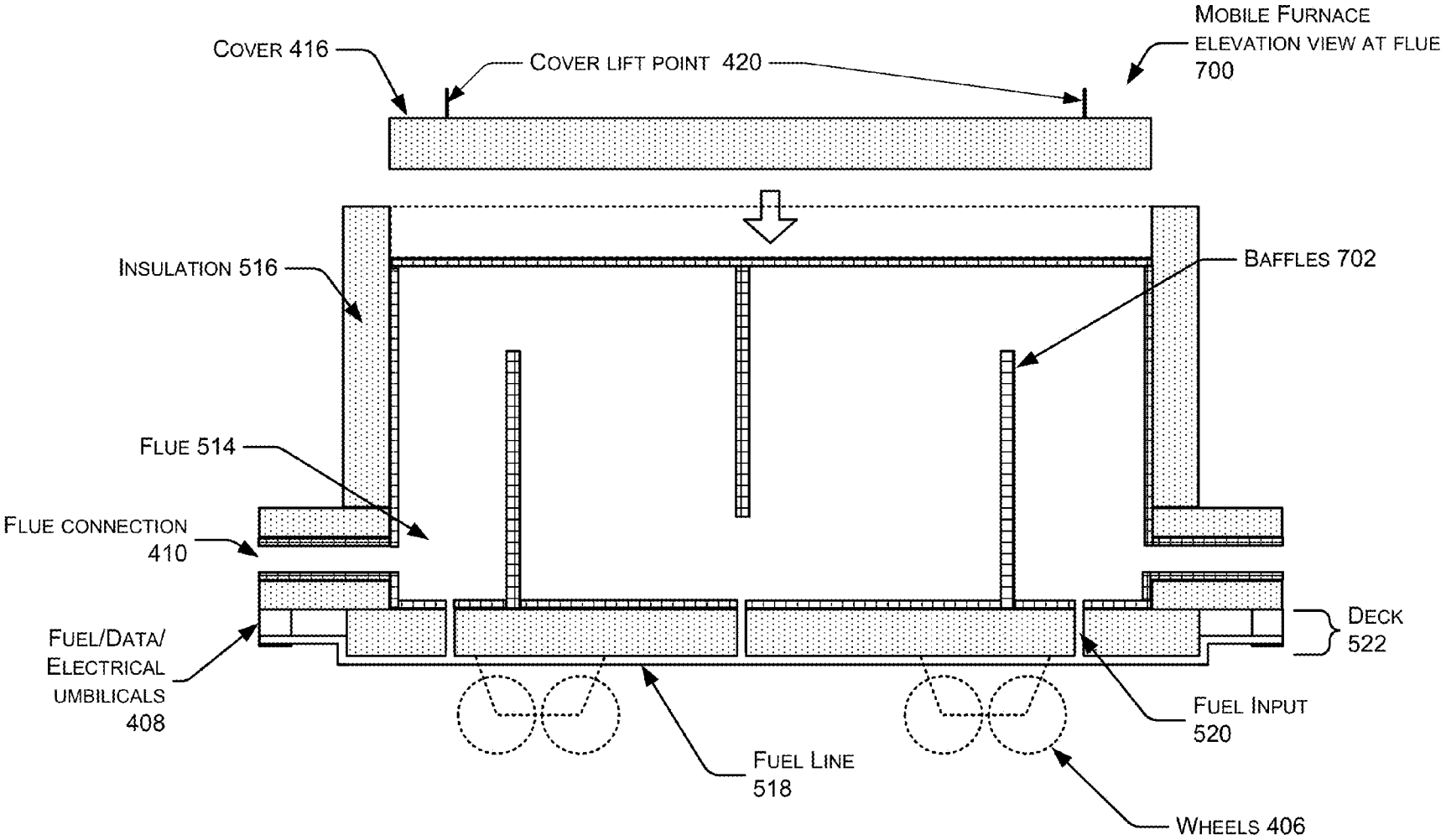
FIG. 7 is a schematic elevation view at a flue of the illustrative mobile furnace of FIG. 3.
Figure 8:
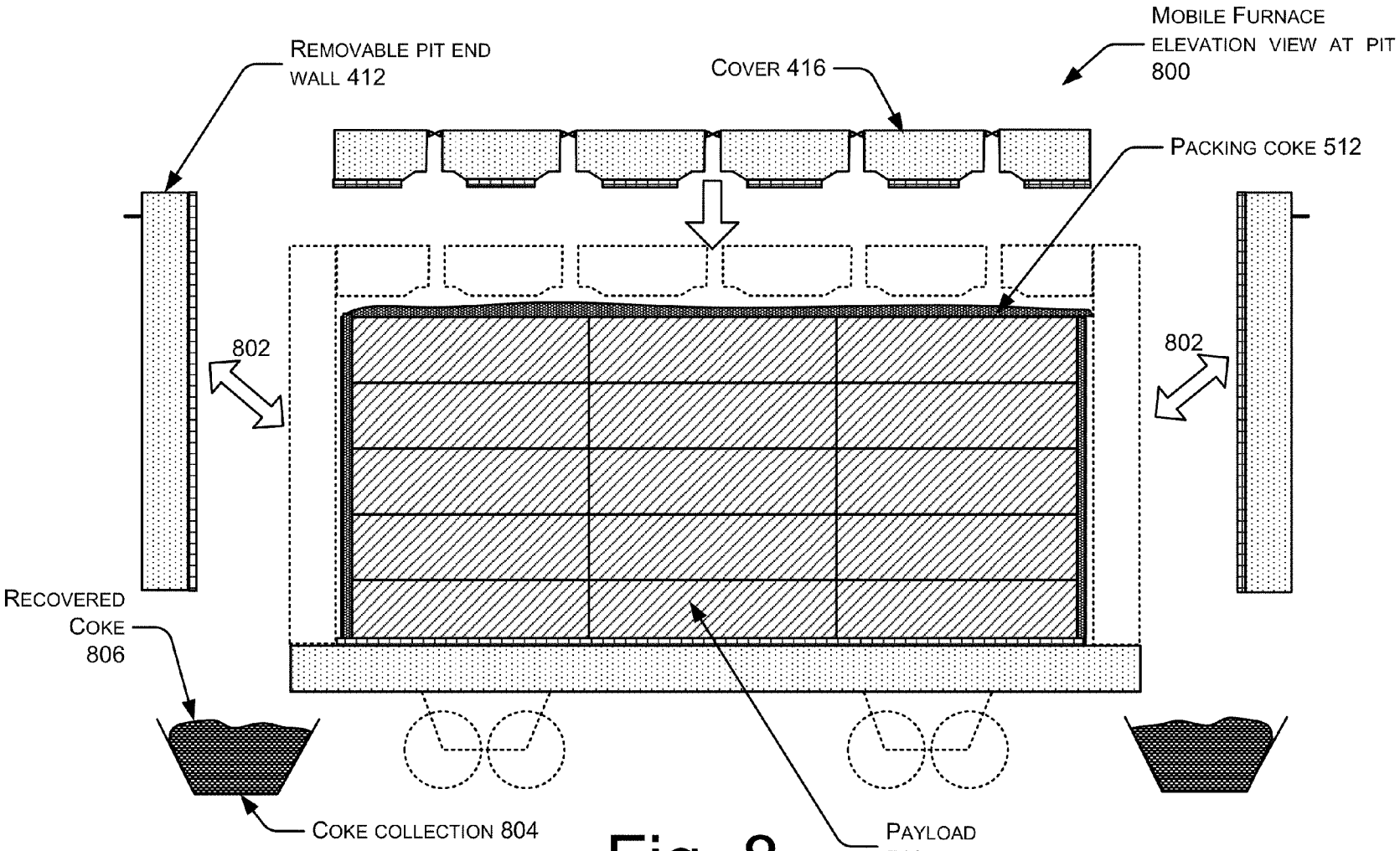
FIG. 8 is a schematic elevation view at a pit of the illustrative mobile furnace of FIG. 3.

For orientation and reference, dashed lines indicate the planes for interior views shown in later figures. An end view plane 422 is shown along the X-Y axes, and is depicted in FIG. 5. A plan view plane 424 is shown along the X-Z axes, and is depicted in FIG. 6. An elevation view plane 426 extending through a flue along the Y-Z axes is depicted in FIG. 7. An elevation view plane 428 extending through a pit along the Y-Z axes is depicted in FIG. 8.

Interior details of one implementation of a mobile furnace are discussed next.

FIG. 5 is a schematic end view 500 of the illustrative mobile furnace of FIG. 4 along plane 422. In this schematic, the cover 416 is shown removed. A dotted line indicates the approximate position of the cover 416 when in place. While a single piece cover is depicted, in other implementations a separate cover may be provided for each pit with a fixed or removable cover for each flue top. Adjustable dampers 502 in the air vents 418 penetrating cover 416 are illustrated. Adjustable dampers 502 allow for more precise control of air which is drawn in over the pits. This air may be used to carry away volatiles outgassed by a payload, as well as providing additional oxygen for combustion. Adjustable dampers 502 may be adjusted manually, mechanically, electronically, pneumatically, hydraulically, and so forth.

A pit 504 is defined by pit walls 506. Pit walls 506 and flue walls may be made of a variety of materials, including fire brick 508. In one implementation, some or all pit walls may be common with a flue. Within a pit 504 is one or more blocks of payload 510. Packing petroleum coke 512 ("coke") or another packing material may be placed on top of payload 510 and between payload 510 and the pit walls 506. Depending upon the desired results, this packing material may act as a heat transfer medium, prevent air burn, provide stability to the payload during movement, and provide a means of preventing product slumping.

Adjacent to a pit is a flue 514. Flue 514 may also be constructed of fire brick 508. Covering the exterior surfaces of the pits and flues is insulation 516. Insulation 516 prevents heat loss, provides protection to workers, etc. The insulation may comprise bricks, batts, foam, aerogel, etc.

Each flue 514 may contain one or more heat sources. This heat source may be a fuel input device, electric resistance heater, etc. In one implementation depicted here, fuel lines 518 extend along the bottom of the mobile furnace. Fuel feeds into the bottom of each flue through fuel inputs 520 in the deck. Fuel input at the bottom of the flue improves uniformity of the pit temperature. In other implementations, the fuel inputs may be located at sides, ends, or top of a flue. Fuel flow for combustion may be controlled at one or more points and with varying levels of granularity. For example, each individual fuel input 520 may be controlled. In another example, the fuel input to a particular mobile furnace or the entire furnace train may be controlled. The generally horizontal surface upon which the pits and flues rest is referred to in this application as the deck 522. Sensors 524 may be positioned within or proximate to flues 514 and/or pits 504 to allow monitoring of the mobile furnace.

FIG. 6 is a schematic plan view 600 of the illustrative mobile furnace of FIG. 4 along plane 424. The insulation 516 comprising the walls of the body 402 and an alternating arrangement of flue 514, pit 504, flue 514, pit 504, and so forth. This arrangement provides heat to both sides of each side of a pit, allowing for more even heat application to the payload. Furthermore, in some implementations portions of one or more pit walls 506 may be permeable and allow migration of volatiles outgassed from the payload to enter the flue for combustion. This reduces explosion danger by combusting these flammable volatiles.

Flue connections 410 at each end of the mobile furnace are visible at the end of each flue 514. In another implementation, each flue 514 may feed into a common plenum on the mobile furnace which in turn feeds a single flue connection 410 at each end of the mobile furnace.

Also visible in this view are the removable pit end walls 412 at each end of each pit 504. Removal of the pit walls conveys several advantages: Loading and unloading of payload into the pits is simplified because of the additional access, which also reduces the amount of packing coke required because it is not necessary to fill in vertical spaces left to accommodate lifting gear. Mechanical damage to pits and flues is also minimized because coke or other packing materials may be drained from the pits via open ends.

In other implementations, other pit and flue configurations in a mobile furnace may be used. For example, pits and flues may be arranged to have a flue adjacent to each pit wall, alternated in a "checkerboard" pattern, arranged at an angle relative to the direction of motion of the furnace train, etc.

FIG. 7 is a schematic elevation view 700 at a flue of the illustrative mobile furnace of FIG. 4 along plane 426. In this schematic, the cover 416 is shown removed. A dotted line indicates the approximate position of the cover 416 when in place. In this view, baffles 702 of fire brick are shown positioned in flue 514. These baffles serve to direct the flow of gasses in the flue to provide more even heating of the flue walls and adjacent pits. Braces (not shown) may also extend from one flue wall to another to add mechanical strength to the flue structure. The internal arrangement of the flue 514 and flue connections 410 may be generally symmetrical, to simplify fire reversal by rotating the mobile furnace's orientation in the fire line. Also shown are the umbilicals 408 at each end of the mobile furnace.

FIG. 8 is a schematic elevation view 800 at a pit of the illustrative mobile furnace of FIG. 4 along plane 428. As above, a dotted line indicates the approximate position of the cover 416 when in place, as well as the removable pit end walls 412. Removable pit end walls 412 may be moved as indicated by arrows 802 to permit loading or unloading of the payload 510, access to the pit 504, and so forth as described above. As described above, once the removable pit end walls 412 have been removed, packing coke 512 may be directed with brooms, shovels, scrapers, air, vacuum, etc., and assisted by gravity into coke collection areas 804. The recovered coke 806 may then be re-used or recycled.

Process of Using a Mobile Furnace

Figure 9:
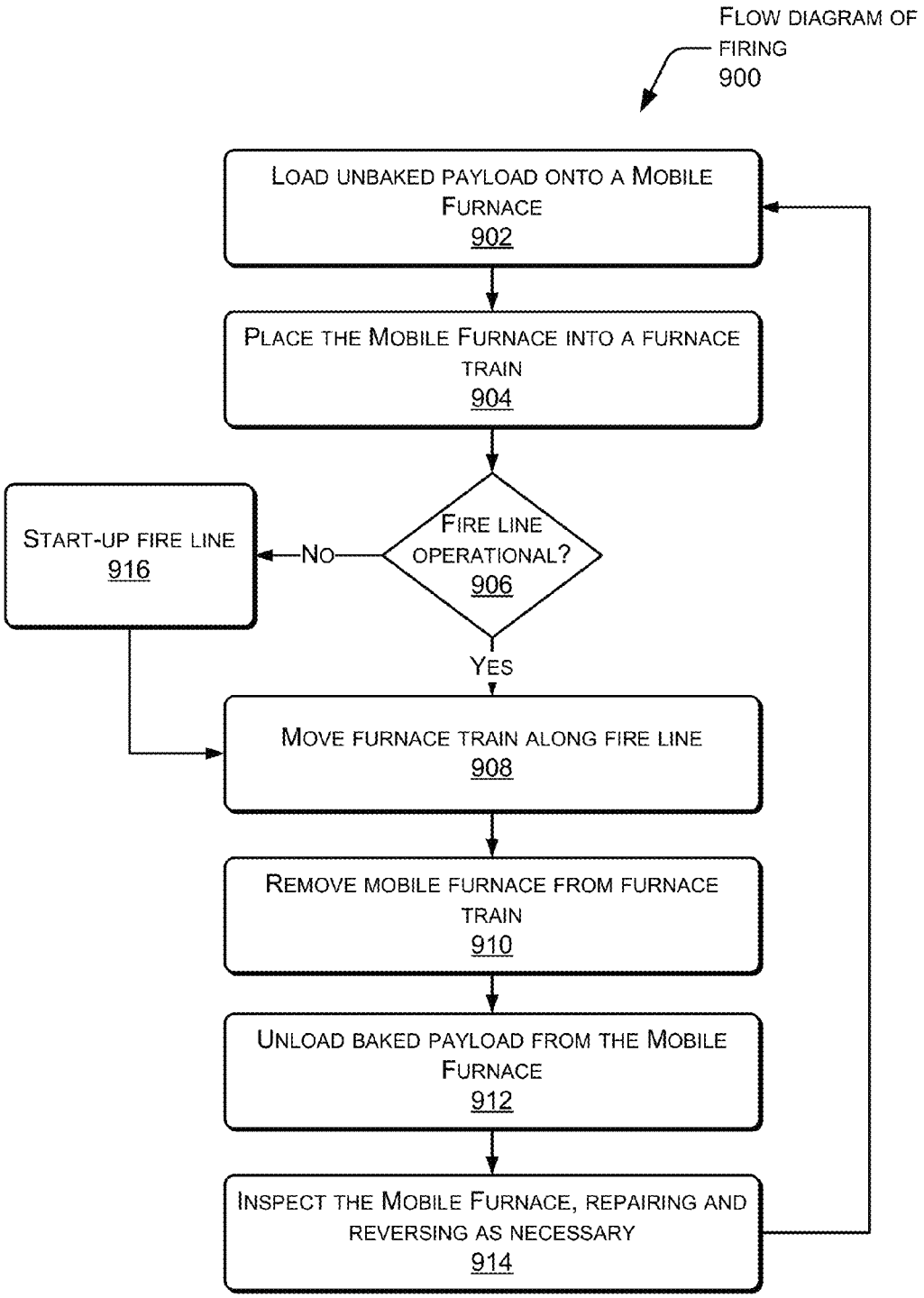
FIG. 9 is a flow diagram of an illustrative process of firing.

FIG. 9 is flow diagram 900 of an illustrative process of firing that may, but need not, be implemented using the architecture shown in FIGS. 1-8. The process 900 will be described in the context of the environment of FIGS. 1-8 for convenience and clarity.

At 902, a mobile furnace is loaded with unbaked payload. As described above, to facilitate loading pit end walls may be removed. Once loading is complete, the pit end walls are put in place. Loading may also include placement of a packing material such as coke between the payload and the pit walls and on top of the payload. A cover may then be placed on the mobile furnace. As described above, this cover permits regulation of temperature and controls air entry into the furnace.

At 904, the mobile furnace is moved to the fire line, and placed into a furnace train. This is described in more depth in FIG. 10 below.

At 906, a determination as to whether the fire line is operational is made. A fire line is operational when hot. In contrast, a "cold" fire line is one which is not in operation. When 906 determines a furnace is operational, at 908 the furnace train is moved along the fire line. This is described in more depth in FIG. 11 below.

At 910, when a mobile furnace has completed its trip through the fire line, it is removed from the furnace train. This is described in more depth in FIG. 12 below.

At 912, the mobile furnace is unloaded. In one implementation, removable pit ends are removed, coke is recovered, and payload is removed. As described above, this takes place in the service line, at a location other than the fire line, increasing worker safety and comfort.

At 914, the mobile furnace is inspected. As describe above, minor repairs may take place at this position, or the mobile furnace may be moved to a maintenance position for more extensive work. When fire reversal is warranted, either because of inspection or as a preventative measure, the mobile furnace may be re-oriented in the line. Once inspected and repaired, the mobile furnace may return to 902 above for loading.

Returning to 906, when the fire line is not operational, at 916 the fire line is started-up. Start-up of a fire line is described in more depth in FIG. 13 below. Once startup is complete, the process continues to 908 as described above.

Figure 10:
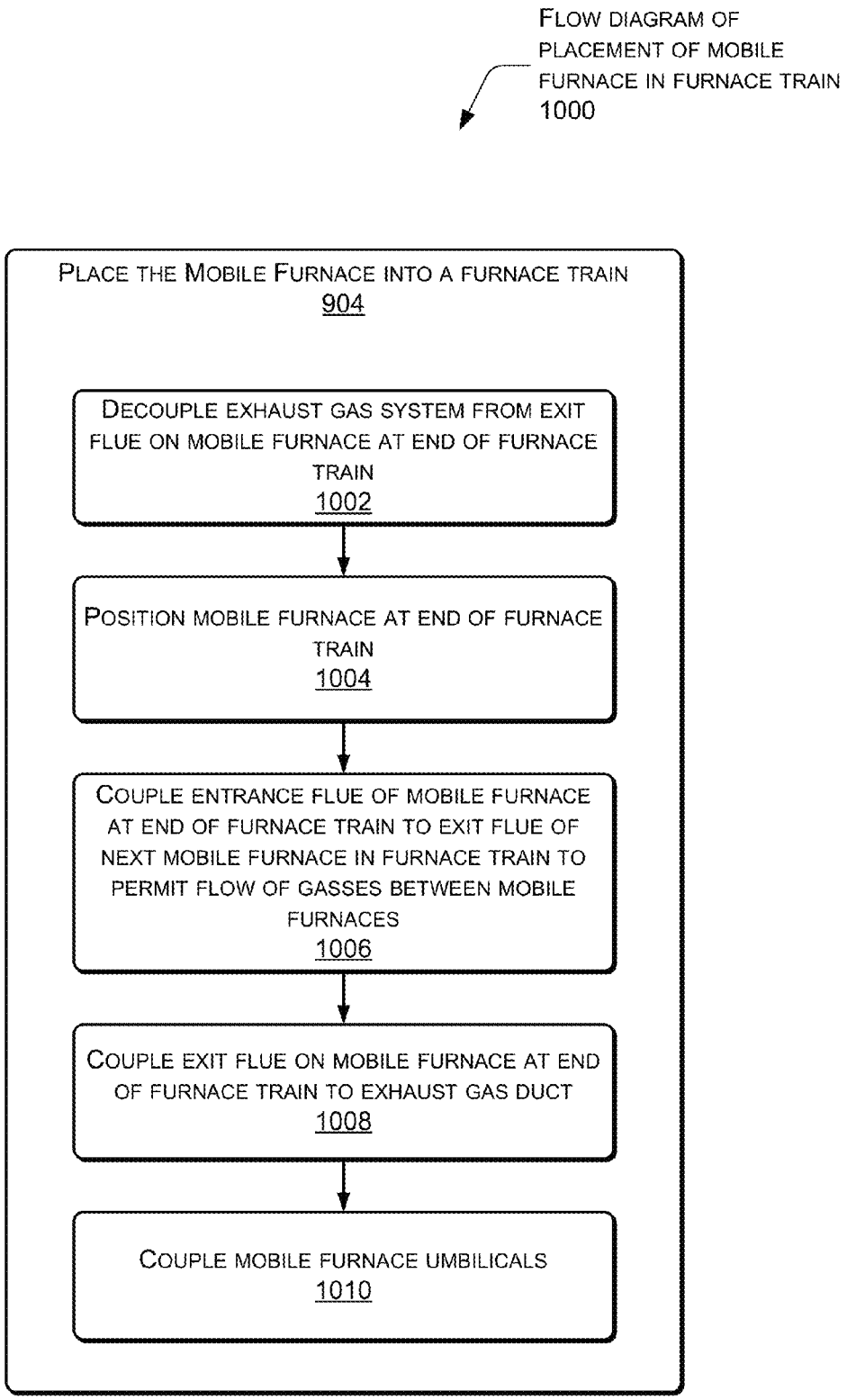
FIG. 10 is a flow diagram of an illustrative process of placing a mobile furnace in a furnace train.

FIG. 10 is flow diagram 1000 of an illustrative process of placing a mobile furnace in a furnace train that may, but need not, be implemented using the architecture shown in FIGS. 1-8. The process 1000 will be described in the context of the environment of FIGS. 1-8 for convenience and clarity.

At 1002, an exhaust gas system is decoupled from the exit flue on the mobile furnace currently at the end of the furnace train. The exhaust gas system may include fans, ductwork, and scrubbers configured to handle the exhaust gas from the fire line. At 1004, a "fresh" mobile furnace is positioned at the end of a furnace train. At 1006, the entrance flue of the "fresh" mobile furnace now at the end of the furnace train is coupled to the exit flue of the next mobile furnace which was previously the end of the furnace train. This coupling permits gasses to flow through the mobile furnaces in the furnace train. At 1008, the exit flue of the "fresh" mobile furnace now at the end of the furnace train is coupled to the exhaust gas system. At 1010, umbilicals between the mobile furnaces are coupled. As described above, these umbilicals may provide fuel, electrical power, and data communications.

Figure 11:
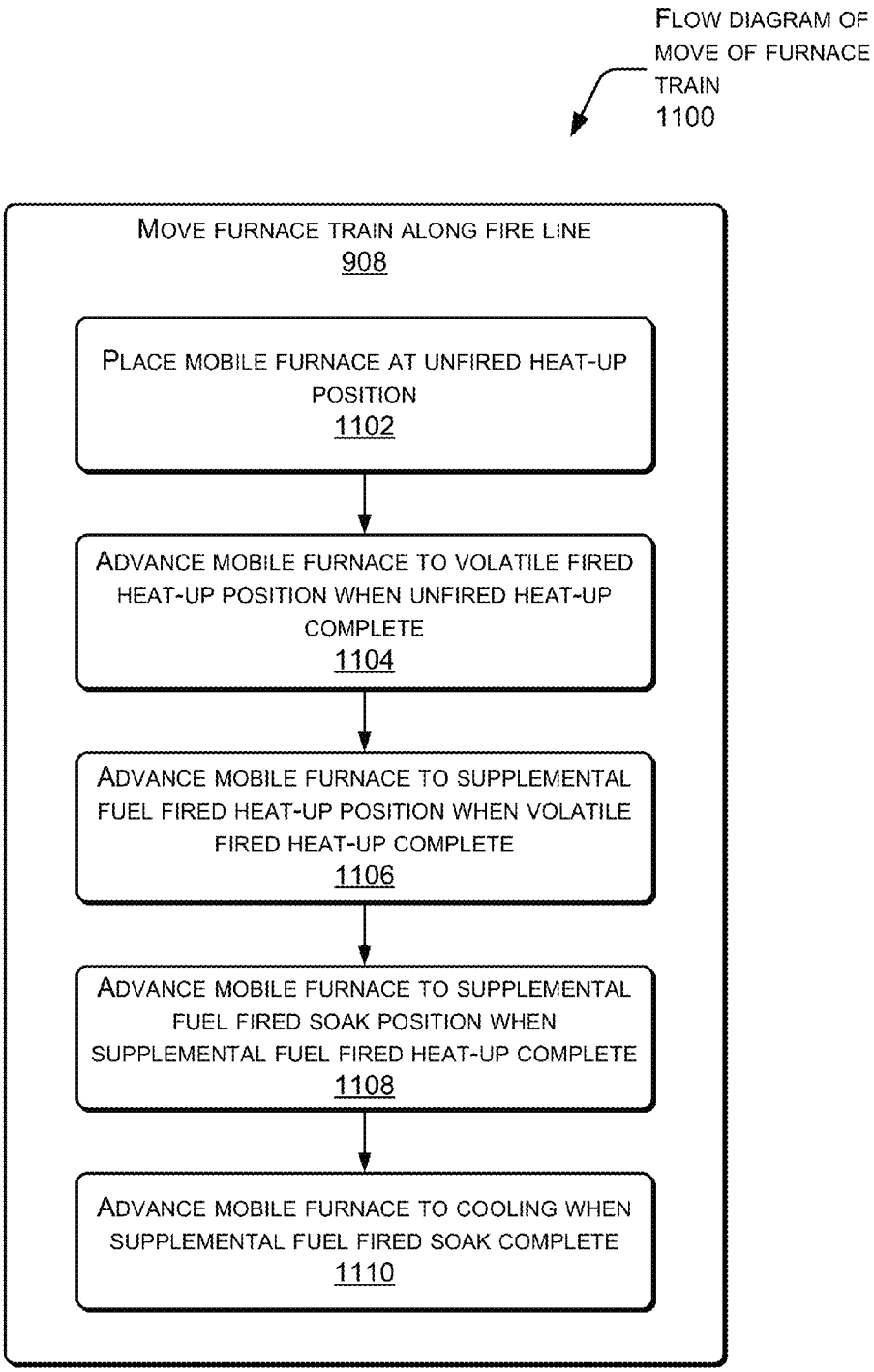
FIG. 11 is a flow diagram of an illustrative process of moving a mobile furnace along a fire line.

FIG. 11 is flow diagram 1100 of an illustrative process of moving a mobile furnace that may, but need not, be implemented using the architecture shown in FIGS. 1-8. The process 1100 will be described in the context of the environment of FIGS. 1-8 and a typical carbon anode bake production profile for convenience and clarity; however other payloads and production profiles may be used.

At 1102, a mobile furnace is placed at an unfired heat-up position. At 1104, once unfired heat-up is complete, the mobile furnace advances to a volatile fired heat-up position. At 1106, once volatile fired heat-up is complete, the mobile furnace advances to a supplemental fuel fired heat-up position. At 1108, once supplemental fuel fired heat-up is complete the mobile furnace advances to a supplemental fuel fired soak position. At 1110, once supplemental fuel fired soak is complete, the mobile furnace advances to a cooling position. In one implementation, all furnaces in a furnace train advance at substantially the same time. As described above, in some implementations positions may be physical locations along a fire line, while in other implementations positions may represent a particular configuration of gas flow between furnaces. As described previously, movement of the furnace train may be incremental or continuous.

Figure 12:
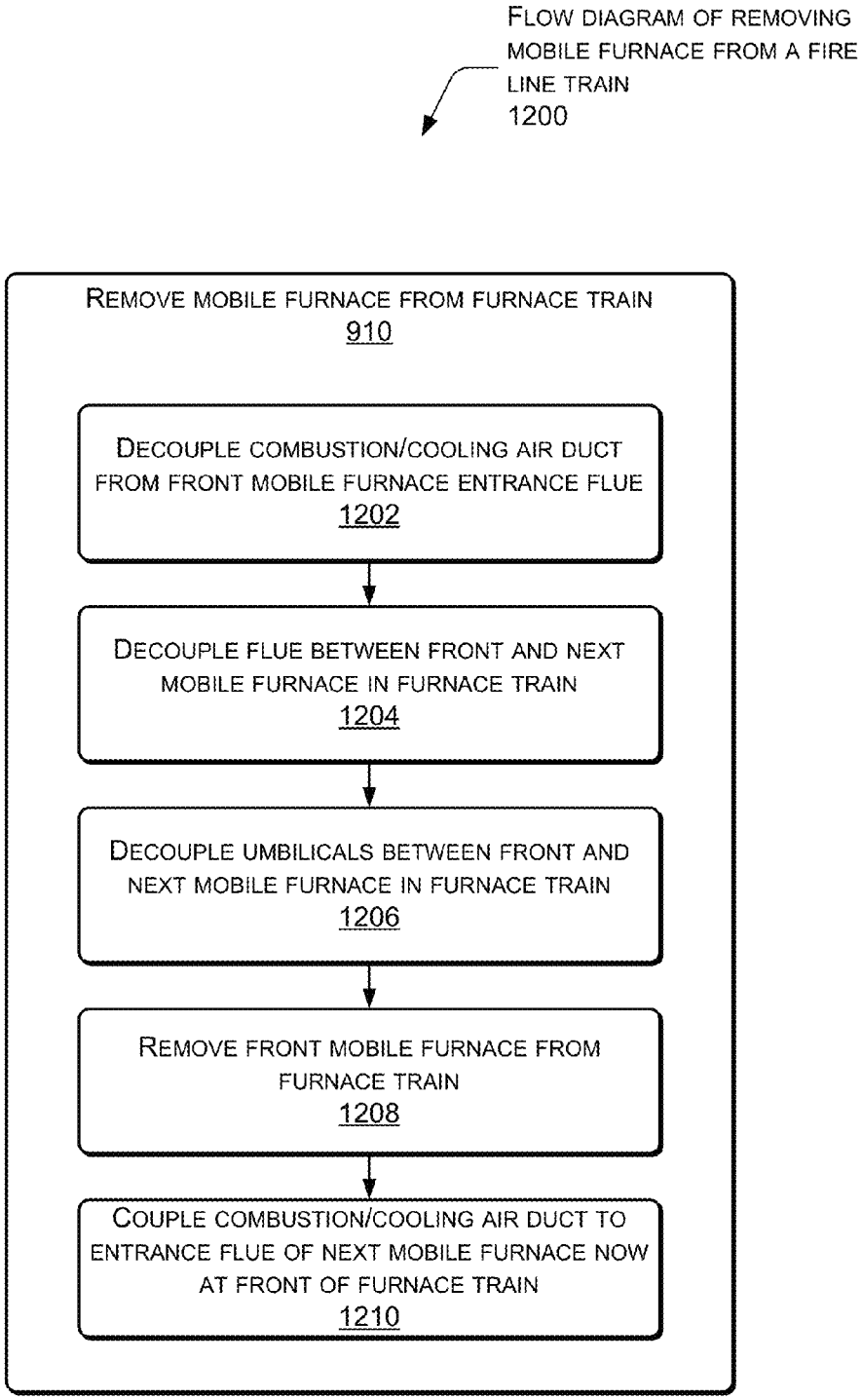
FIG. 12 is a flow diagram of an illustrative process of removing a mobile furnace from a furnace train.

FIG. 12 is flow diagram 1200 of an illustrative process of removing a mobile furnace from a furnace train that may, but need not, be implemented using the architecture shown in FIGS. 1-8. The process 1200 will be described in the context of the environment of FIGS. 1-8 for convenience and clarity.

At 1202, a combustion/cooling air duct is decoupled from the entrance flue on a mobile furnace at the front of a furnace train. At 1204, the flue connections between the front and next mobile furnace in the furnace train are decoupled. At 1206, umbilical connections between the front and next mobile furnace in the furnace train are decoupled. At 1208, the now decoupled front mobile furnace is removed from the furnace train. At 1210, the combustion/cooling air duct is coupled to the entrance flue of the next mobile furnace, which is now at the front of the furnace train.

While the above process describes decoupling a single mobile furnace, in some implementations two or more mobile furnaces may be decoupled from the furnace train. Also, while the above process describes removing mobile furnaces at the front of the furnace train, a mobile furnace may be removed in similar fashion from any point in the furnace train. For example, this may become necessary in the event of a catastrophic failure in a mobile furnace during firing. In such a situation, the quick decoupling and re-coupling cycle time would permit removal of the problematic mobile furnace with minimal interruption to the production process.

Figure 13:
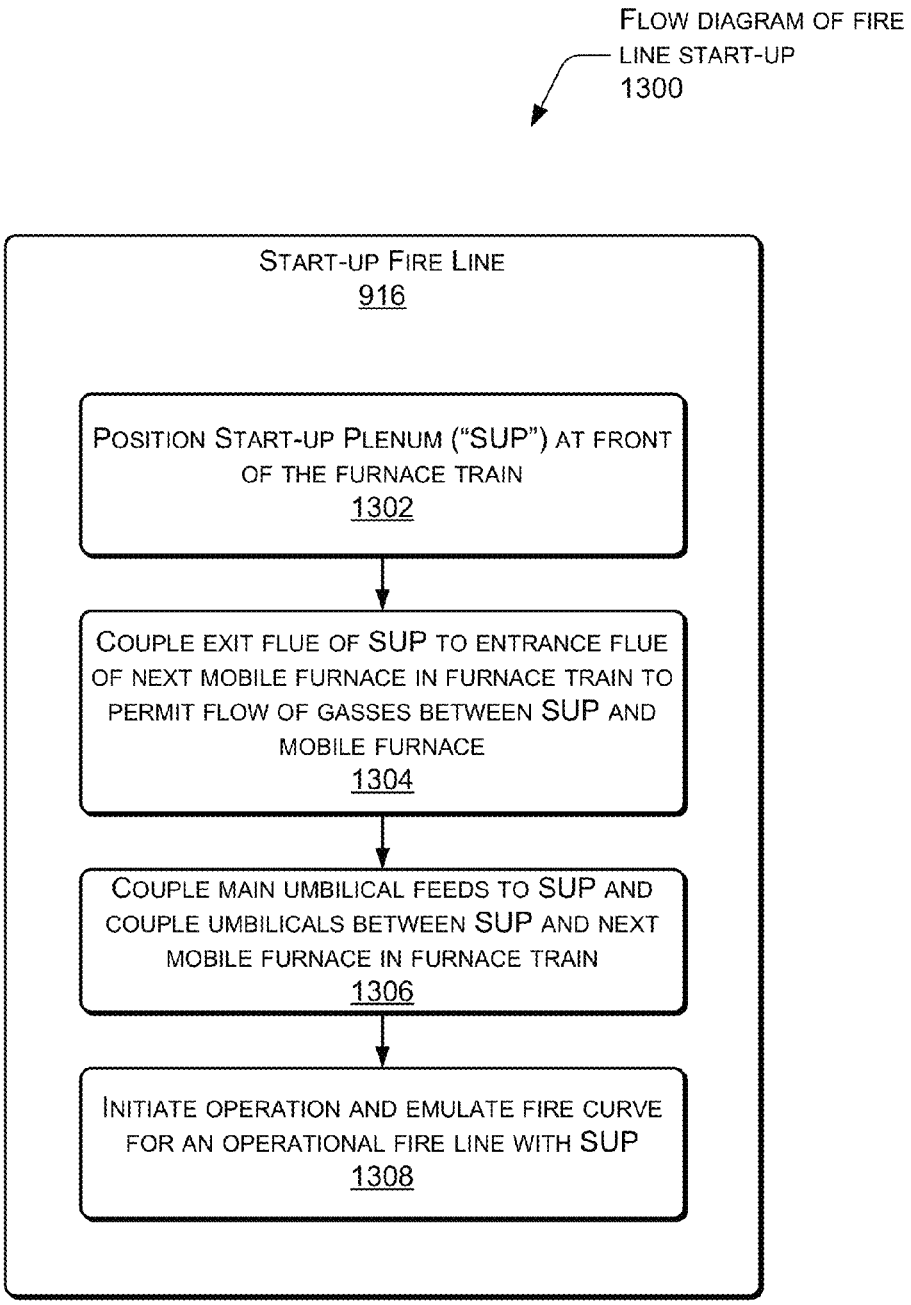
FIG. 13 is a flow diagram of an illustrative process of starting a fire line.

FIG. 13 is flow diagram 1300 of an illustrative process of starting up a fire line that may, but need not, be implemented using the architecture shown in FIGS. 1-8. The process 1300 will be described in the context of the environment of FIGS. 1-8 for convenience and clarity.

When a fire line is in a cold state, a start-up process may be used to bring the fire line and associated furnace train up to operational condition. At 1302 a start-up plenum ("SUP") is positioned at the front of a new furnace train. As described above with respect to FIG. 3, the SUP is configured to emulate the performance of a mobile furnace during normal operation, and provide the expected temperatures and other parameters necessary for the furnace train. This may be a dedicated device, or a mobile furnace which has been modified. These modifications may include additional blowers, additional fuel inputs, etc.

At 1304, the exit flue of the SUP is coupled to the entrance flue of a next mobile furnace in the furnace train. As described previously, this coupling permits a flow of gasses between the SUP and the mobile furnace. At 1306 main umbilical feeds from the fire line to the SUP and the umbilicals between the SUP and the next mobile furnace in the train are coupled. In another implementation, a combustion/cooling air duct is coupled to an entrance flue of the SUP.

At 1308, operation of the fire line is initiated and the SUP emulates operational characteristics, such as the fire curve, of a fully operational fire line. As described previously, when the SUP reaches the end of the fire line process, it may be removed. In another implementation, the SUP may be placed into an operational fire line to introduce a significant change in production profile.

Non-Stationary Furnace Fire Line

Figure 14:
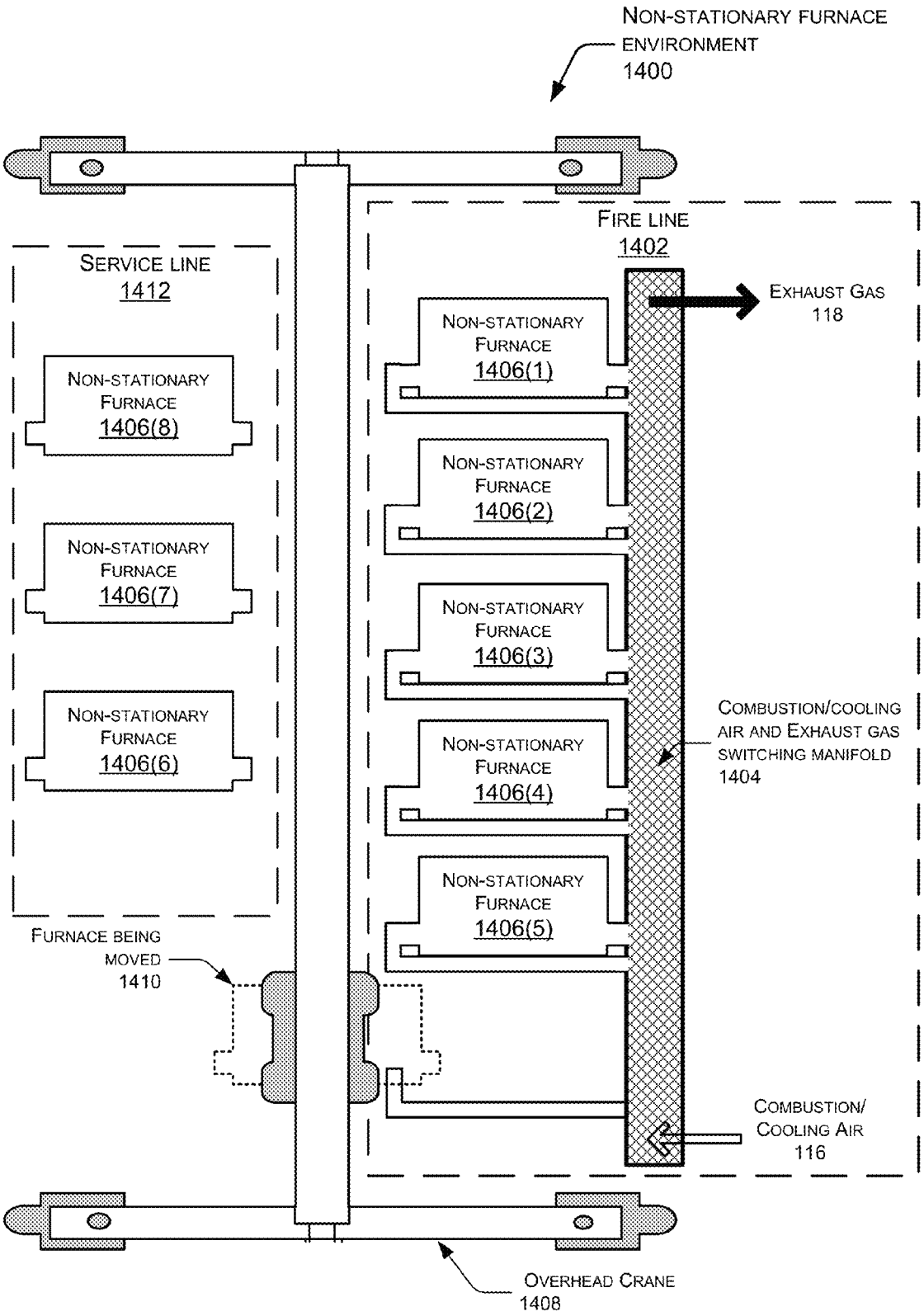
FIG. 14 is a schematic of an illustrative non-stationary furnace environment.

FIG. 14 is schematic of an illustrative non-stationary furnace environment 1400. In this alternative implementation, non-stationary furnaces are used. A non-stationary furnace is a mobile furnace with limited mobility. For example, a non-stationary furnace may be one which can be moved in its entirety by an overhead crane rather than wheels.

In this implementation, a fire line 1402 is depicted which includes a combustion/cooling air and exhaust gas switching manifold ("switching manifold") 1404. Switching manifold 1404 allows for redirection of combustion/cooling air 116 and exhaust gas 118 to various combinations of non-stationary furnaces 1406 to produce a gas flow equivalent to that described above with respect to a linear furnace train. During the firing process, the non-stationary furnaces remain in place. Gas from a non-stationary furnace flue is redirected with the switching manifold 1406. In this illustration, non-stationary furnaces 1406(1), 1406(2), 1406(3), 1406(4), and 1406(5) are shown attached to switching manifold 1404 for firing.

When a non-stationary furnace has cooled sufficiently it may be decoupled from the switching manifold 1404. An overhead crane 1408 or other device retrieves the cooled non-stationary furnace 1410 from the fire line and moves it to a desired position in a service line 1412. Non-stationary furnaces 1406(6), 1406(7), and 1406(8) are shown in service line 1412. Within service line 1412 may be an unloading area, inspection area, maintenance area, loading position, etc. as described above with respect to FIG. 1.

In addition to a new installation, a non-stationary furnace fire line may suitable for retrofit of existing OTFs. For example, non-stationary furnaces could be installed into an OTF facility after removal of the conventional OTF refractory and modification of the existing exhaust gas handling equipment. Thus, many of the advantages described above with regards to the mobile furnace are realized while re-using portions of an existing facility.

CONCLUSION

Although the subject matter has been described in language specific to structural features and/or methodological acts, it is to be understood that the subject matter defined in the appended claims is not necessarily limited to the specific features, dimensions, or acts described. Rather, the specific features, dimensions, and acts are disclosed as illustrative forms of implementing the claims. Moreover, any of the features of any of the devices described herein may be implemented in a variety of materials or similar configurations.

What is claimed is:

1. A system comprising:
- a mobile furnace configured to accept payload, wherein the mobile furnace is configured to:
  - couple to a fire line, wherein the fire line comprises a plurality of mobile furnaces configured to maintain a plurality of production profiles, and
  - periodically move along the fire line in a direction of travel through the plurality of production profiles, wherein the mobile furnace comprises:
    - a transport mechanism configured to move the mobile furnace along the fire line in a direction of travel;
    - one or more flues, wherein each flue is configured to permit a flow of first gasses to or from another mobile furnace;
    - one or more fuel inputs; and
    - one or more pits, wherein each of the pits:
      - comprises one or more removable pit end walls, and
      - comprises one or more fixed pit walls, wherein the one or more fixed pit walls are adjacent to one or more of the flues, and each of the pits are configured to:
        - carry the payload within the one or more fixed pit walls and the one or more removable pit end walls.

2. The system of claim 1, wherein the each of the pits are further configured to:
- permit a transfer of one or more volatile gasses released by the payload during heating to the one or more flues adjacent to the pit;
- wherein each of the one or more flues is configured to maintain a first gas composition within the one or more flues at a negative pressure relative to a second gas composition within the one or more pits, such that the one or more volatile gasses present in the second gas composition are drawn into the one or more flues.

3. The system of claim 1, wherein an orientation associated with the mobile furnace is configured to be rotated with respect to the direction of travel in the fire line during a subsequent pass through the fire line.

4. The system of claim 1, wherein two or more mobile furnaces in the fire line are configured to be moved contemporaneously.

5. The system of claim 1, wherein the mobile furnace further comprises a heat source based at least in part on combustion of volatile gasses outgassed by the payload.

6. A system comprising:
- a mobile furnace configured to accept payload, wherein the mobile furnace is configured to:
  - couple to a fire line, wherein the fire line comprises a plurality of mobile furnaces configured to maintain a plurality of production profiles, and
  - periodically transition the mobile furnace through the plurality of production profiles, wherein the mobile furnace comprises:
    - a transport mechanism configured to move the mobile furnace;
    - one or more flues, wherein each flue is configured to permit a flow of first gasses to or from another mobile furnace;
    - one or more fuel inputs; and
    - one or more pits, wherein each of the pits:

comprises one or more removable pit end walls, and comprises one or more fixed pit walls, wherein the one or more fixed pit walls are adjacent to one or more of the flues, and each of the pits are configured to:

carry the payload within the one or more fixed pit walls and the one or more removable pit end walls.

7. The system of claim 6, wherein the each of the pits are further configured to:

permit a transfer of one or more volatile gasses released by the payload during heating to the one or more flues adjacent to the pit.

8. The system of claim 6, wherein an orientation associated with the mobile furnace is configured to be rotated with respect to the flow of first gasses to or from another mobile furnace during a subsequent pass through the fire line.

9. The system of claim 6, wherein two or more mobile furnaces in the fire line are configured to be moved contemporaneously.

10. The system of claim 6, wherein the mobile furnace further comprises a heat source based at least in part on combustion of volatile gasses outgassed by the payload.

11. The system of claim 6, wherein each of the plurality of mobile furnaces is configured to move along the fire line in a direction of travel.

12. The system of claim 6, wherein the payload remains within the mobile furnace throughout each of the plurality of production profiles.

13. The system of claim 6, wherein the production profile comprises one or more of the following:

an unfired heat-up of the one or more mobile furnaces in the fire line, a volatile fired heat-up of the one or more mobile furnaces in the fire line, a supplemental fuel fired heat-up of the one or more mobile furnaces in the fire line, or a cooling of the one or more mobile furnaces in the fire line.

14. A system comprising:

a mobile furnace configured to accept a payload, wherein the mobile furnace is configured to:

couple to a fire line, wherein the fire line comprises a plurality of mobile furnaces, wherein a first portion of the plurality of mobile furnaces maintains a first production profile and a second portion of the plurality of mobile furnaces maintains a second production profile, and periodically transition the mobile furnace from the first production profile to the second production profile, wherein the mobile furnace comprises:

a transport mechanism configured to move the mobile furnace;

one or more flues, wherein each flue is configured to permit a flow of first gasses with another mobile furnace;

one or more fuel inputs; and one or more pits, wherein each of the pits:

comprises one or more removable pit end walls, and comprises one or more fixed pit walls, and each of the pits are configured to:

carry the payload within the one or more fixed pit walls and the one or more removable pit end walls.

15. The system of claim 14, wherein one or more of the first production profile or the second profile comprises one or more of the following:

an unfired heat-up of the one or more mobile furnaces in the fire line, a volatile fired heat-up of the one or more mobile furnaces in the fire line, a supplemental fuel fired heat-up of the one or more mobile furnaces in the fire line, or a cooling of the one or more mobile furnaces in the fire line.

16. The system of claim 14, wherein the flue is configured to draw gasses produced by the payload from the pit into the flue.

17. The system of claim 14, further comprising one or more fuel inputs located at a bottom of the one or more flues.

18. The system of claim 14, wherein the payload remains within the mobile furnace throughout operation of the first production profile and the second production profile.

19. The system of claim 14, wherein each of the one or more flues is configured to maintain a negative pressure relative to the one or more pits.

20. The system of claim 14, further comprising a start-up plenum configured to simulate behavior of one or more additional mobile furnaces associated with a furnace train.

* * * * *